US012638232B2

(12) United States Patent
Jeong

(10) Patent No.: US 12,638,232 B2
(45) Date of Patent: May 26, 2026

(54) REFRIGERATOR

(71) Applicant: SAMSUNG ELECTRONICS CO., LTD., Suwon-si (KR)

(72) Inventor: Youngkyun Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 93 days.

(21) Appl. No.: 18/650,753

(22) Filed: Apr. 30, 2024

(65) Prior Publication Data

US 2024/0280315 A1 Aug. 22, 2024

Related U.S. Application Data

(63) Continuation of application No. PCT/KR2022/016910, filed on Nov. 1, 2022.

(30) Foreign Application Priority Data

Dec. 27, 2021 (KR) ..... 10-2021-0188382

(51) Int. Cl.
*F25D 23/06* (2006.01)
*F25D 19/04* (2006.01)

(52) U.S. Cl.
CPC ..... *F25D 23/067* (2013.01); *F25D 19/04* (2013.01); *F25D 2400/16* (2013.01); *F25D 2400/38* (2013.01)

(58) Field of Classification Search
CPC ..... F25D 23/065; F25D 23/062; F25D 23/06; F25D 2400/16; F25D 23/069;
(Continued)

(56) References Cited

U.S. PATENT DOCUMENTS 4,462,225 A * 7/1984 Noe ..... D06F 29/005 68/3 R
4,977,754 A * 12/1990 Upton ..... A47F 3/0408 62/277

(Continued)

FOREIGN PATENT DOCUMENTS

CN 204574680 U 8/2015
CN 108626939 B 4/2021

(Continued)

OTHER PUBLICATIONS

KR19990020204 translation (Year: 1999).*

(Continued)

*Primary Examiner* — Hiwot E Tefera
(74) *Attorney, Agent, or Firm* — STAAS & HALSEY LLP

(57) ABSTRACT

A refrigerator according to an embodiment of the disclosure includes a first refrigerator, a second refrigerator stackable on an upper side of the first refrigerator and including a caster disposed on a rear lower side thereof, and a support module disposed between the first refrigerator and the second refrigerator to allow the second refrigerator to be stacked on an upper side of the first refrigerator, wherein the support module includes a main plate coupled to an upper wall of the first refrigerator, a leg disposed on a front side of the main plate to support a front lower side of the second refrigerator, a guide plate coupled to a rear side of the main plate, and a guide lever vertically movably coupled to the guide plate so as to support the caster to move vertically.

16 Claims, 27 Drawing Sheets

(58) Field of Classification Search
CPC .... F25D 23/00; F25D 2400/32; F25D 23/067; F25D 19/04; F25D 2400/38; F25D 23/028; D06F 39/125; D06F 31/00; D06F 39/12
See application file for complete search history.

(56) References Cited

U.S. PATENT DOCUMENTS

| | | | | |
|---|---|---|---|---|
| 6,427,966 | B1 * | 8/2002 | Blumenschein | A47B 91/005 248/646 |
| 7,685,846 | B2 | 3/2010 | Hwang et al. | |
| 10,427,701 | B1 * | 10/2019 | Brede | B62B 3/02 |
| 2005/0172678 | A1 * | 8/2005 | Kim | D06F 39/125 68/3 R |
| 2006/0010934 | A1 | 1/2006 | Kim | |
| 2009/0146536 | A1 * | 6/2009 | Kim | D06F 39/125 16/415 |
| 2009/0235551 | A1 * | 9/2009 | Jo | D06F 29/00 34/427 |
| 2010/0115784 | A1 * | 5/2010 | Jo | D06F 39/125 700/282 |
| 2010/0201236 | A1 * | 8/2010 | Kim | D06F 39/125 312/228 |
| 2011/0041560 | A1 * | 2/2011 | Lee | D06F 39/125 68/9 |
| 2016/0010719 | A1 * | 1/2016 | Kim | F16M 9/00 248/673 |
| 2018/0340285 | A1 | 11/2018 | Choi et al. | |
| 2019/0120544 | A1 * | 4/2019 | Deka | F16L 59/065 |
| 2020/0370817 | A1 * | 11/2020 | Nam | F25D 21/14 |
| 2021/0180821 | A1 | 6/2021 | Cha | |
| 2021/0214879 | A1 * | 7/2021 | Lee | D06F 39/125 |
| 2021/0269957 | A1 | 9/2021 | Jin et al. | |
| 2022/0090844 | A1 * | 3/2022 | Shibuya | F25D 19/04 |
| 2023/0384020 | A1 | 11/2023 | Nam et al. | |

FOREIGN PATENT DOCUMENTS

| | | | | |
|---|---|---|---|---|
| DE | 102006018421 | A1 * | 10/2007 | F25D 23/00 |
| JP | H04327779 | * | 11/1992 | |
| KR | 20-1998-0058238 | | 10/1998 | |
| KR | 19980058238 | U * | 10/1998 | |
| KR | 20-1999-0020204 | | 6/1999 | |
| KR | 10-2006-0005849 | | 1/2006 | |
| KR | 10-2009-0127763 | | 12/2009 | |
| KR | 10-2010-0020628 | | 2/2010 | |
| KR | 10-2017-0002888 | | 1/2017 | |
| KR | 10-2017-0062180 | | 6/2017 | |
| KR | 10-2019-0070787 | | 6/2019 | |
| KR | 20-0489767 | | 8/2019 | |
| KR | 10-2021-0058240 | | 5/2021 | |
| KR | 10-2568737 | | 8/2023 | |
| WO | WO 2012/121453 | A1 | 9/2012 | |
| WO | WO 2007/074039 | A1 | 7/2017 | |

OTHER PUBLICATIONS

International Search Report dated Feb. 14, 2023 issued in PCT Application No. PCT/KR2022/016910.
Written Opinion dated Feb. 14, 2023 issued in PCT Application No. PCT/KR2022/016910.

* cited by examiner

REFRIGERATOR

CROSS REFERENCE TO THE RELATED APPLICATION

This application is a continuation application, filed under 35 U.S.C. § 111(a), of International Application PCT/KR2022/016910 filed Nov. 1, 2022, and is based on and claims priority under 35 U.S.C. § 119 to Korean Patent Applications No. 10-2021-0188382, filed on Dec. 27, 2021 in the Korean Intellectual Property Office, the disclosures of which are incorporated by reference herein in their entireties.

TECHNICAL FIELD

The disclosure relates to a refrigerator, and more particularly, to a plurality of small stackable refrigerators.

BACKGROUND ART

In general, a refrigerator, an appliance for keeping food fresh, includes a main body having a storage compartment and a cold air supply device for supplying cold air to the storage compartment. The storage compartment includes a refrigerating compartment in which the food is kept refrigerated at a temperature of approximately 0° C. to 5° C., and a freezing compartment in which the food is kept frozen at a temperature of approximately 0° C. to −30° C. Typically, the storage compartment is arranged to be open at the front for placing or removing food, and the open front of the storage compartment is opened or closed by a door.

On the other hand, there are cases where a plurality of small refrigerators are used by stacking them in a vertical direction, and in such cases a structure for stacking an upper refrigerator on a lower refrigerator is provided. However, when the upper refrigerator is installed on top of the lower refrigerator, tilting may occur, and after the upper refrigerator is installed on top of the lower refrigerator, the upper refrigerator may also tilt or move by opening and closing the door of the upper refrigerator or by an external shock.

DISCLOSURE

Technical Problem

The present disclosure is directed to a refrigerator including a support module that allows an upper refrigerator to be easily coupled to a lower refrigerator while adjusting a side-to-side and front-to-back inclination of the upper refrigerator.

Further, the present disclosure is directed to a refrigerator including a structure that allows air to enter a space between an upper refrigerator and a lower refrigerator without exposing the space between the upper refrigerator and the lower refrigerator.

Further, the present disclosure is directed to a refrigerator including a structure that allows the size of a support module to change regardless of the size of the refrigerator.

Technical Solution

According to an embodiment of the present disclosure, a refrigerator includes a first refrigerator, a second refrigerator stackable on an upper side of the first refrigerator and including a caster disposed on a rear lower side thereof, and a support module disposed between the first refrigerator and the second refrigerator to allow the second refrigerator to be stacked on the upper side of the first refrigerator, wherein the support module includes a main plate coupled to an upper wall of the first refrigerator, a leg disposed on a front side of the main plate to support a front lower side of the second refrigerator, a guide plate coupled to a rear side of the main plate, and a guide lever vertically movably coupled to the guide plate so as to support the caster to move vertically.

The support module may adjust a step between the second refrigerator and the first refrigerator by moving the caster vertically based on a rotation of the guide lever.

The guide lever may include a seating member on which the caster is seated, and a rotating member disposed on a lower side of the seating member and configured to move the seating member vertically based on a rotation of the rotating member.

The guide plate may include a coupling hole into which the rotating member is inserted, and the rotating member may include a rotating shaft inserted into the coupling hole and a rotating plate disposed on an upper side of the rotating shaft to support the seating member.

The seating member may have a shape of a hexagonal plate.

The guide plate may include an insertion hole disposed on a front side thereof, and the main plate may include an insertion protrusion protruding rearwardly and downwardly so as to be inserted into the insertion hole.

The support module may include a front cover disposed on the front side of the main plate, and a bracket disposed between the front cover and the main plate to secure the leg.

The front cover may include a blade extending in a left-to-right direction of the first refrigerator and forming an opening to flow external air from the front into a space between the first refrigerator and the second refrigerator.

The blade may extend rearwardly and is arranged to be inclined upwardly to allow external air to flow into the space between the first refrigerator and the second refrigerator.

The main plate may include a body and an outer wall extending upwardly from an outside of the body to cover the space between the first refrigerator and the second refrigerator.

The guide plate may include a body coupled to the guide lever and an outer wall extending upwardly from the outside of the body, and the outer wall of the guide plate may have a height corresponding to a height of the outer wall of the main plate.

The main plate may include an inner wall extending upwardly from the body in a direction opposite to the outer wall and formed to be lower in height than the outer wall, and the inner wall may include an inclined surface formed to be inclined upwardly toward the outer wall to guide air.

The refrigerator may further include, between the main plate and the guide plate, a sub-plate detachably coupled to the main plate and the guide plate, respectively.

The guide plate may include an insertion hole disposed on a front side thereof, the main plate may include an insertion protrusion protruding toward a rear lower side, and the sub-plate may include a body including an insertion hole at the front into which the insertion protrusion of the main plate is inserted, and an insertion protrusion at the rear protruding rearwardly and downwardly to be inserted into the insertion hole of the guide plate.

The bracket may include an inlet extending in a left-to-right direction of the first refrigerator and configured to flow external air into a space between the first refrigerator and the second refrigerator, and the support module may further include a fastener couplable from a rear side of the guide plate, extending in a left-to-right direction of the first refrigerator, and including an outlet configured to discharge air between the first refrigerator and the second refrigerator to the outside.

According to another embodiment of the present disclosure, a refrigerator includes a first refrigerator, a second refrigerator stacked on an upper side of the first refrigerator and including a caster disposed on a rear lower side thereof, and a support module disposed between the first refrigerator and the second refrigerator to allow the second refrigerator to be stacked on an upper side of the first refrigerator, wherein the support module includes a main plate coupled to an upper wall of the first refrigerator and extending in a front-to-back direction of the first refrigerator, a leg coupled to the second refrigerator and disposed on a front side of the main plate to support a lower portion of the second refrigerator, a guide plate disposed on a rear side of the main plate and detachably coupled to the main plate, and a guide lever disposed on an upper side of the guide plate, coupled to the guide plate, and supporting the caster to move vertically the caster while rotating the caster.

The guide lever may include a seating member on which the caster is seated, and a rotating member disposed on a lower side of the seating member and configured to move vertically the seating member up as the rotating member rotates.

The guide plate may include a coupling hole into which the rotating member is inserted, and the rotating member may include a rotating shaft inserted into the coupling hole and a rotating plate disposed on an upper side of the rotating shaft to support the seating member.

The support module may further include a front cover including a blade disposed on the front side of the main plate and extending in a left-to-right direction of the first refrigerator to form openings arranged to flow external air into a space between the first refrigerator and the second refrigerator, and a sub-plate couplable with the main plate and the guide plate.

According to another embodiment of the present disclosure, a refrigerator includes a first refrigerator, a second refrigerator stacked on an upper side of the first refrigerator and coupled to a caster at a rear lower side thereof, and a support module disposed between the first refrigerator and the second refrigerator to allow the second refrigerator to be stacked on upper side of the first refrigerator, wherein the support module includes a leg located on an upper side of the first refrigerator and coupled to the second refrigerator, a front cover disposed on a front side of the leg, extending from side to side of the first refrigerator to cover the first refrigerator and the second refrigerator, and including an opening to flow external air into a space between the first refrigerator and the second refrigerator, a main plate installed on an upper wall of the first refrigerator, extending in a front-to-back direction of the first refrigerator, and disposed on a rear side of the leg, a guide plate disposed on a rear side of the main plate and detachably coupled to the main plate, a guide lever coupled to the guide plate and including a seating member supporting the caster and a rotating member coupled to a lower side of the seating member, and a fastener coupled to a rear side of the guide plate to secure the guide plate and including an outlet for discharging air between the first refrigerator and the second refrigerator.

Advantageous Effects

According to an aspect of the present disclosure, it is possible to provide the refrigerator including the support module capable of adjusting the inclination of the upper refrigerator and the lower refrigerator in the front-to-back direction as well as in the left-to-right direction.

Further, according to an aspect of the present disclosure, air may be introduced without exposing the space between the upper refrigerator and lower refrigerator.

Further, according to an aspect of the present disclosure, the refrigerator may include the support module whose length is adjustable according to the size of the refrigerator.

MODES OF THE INVENTION

Figure 1:
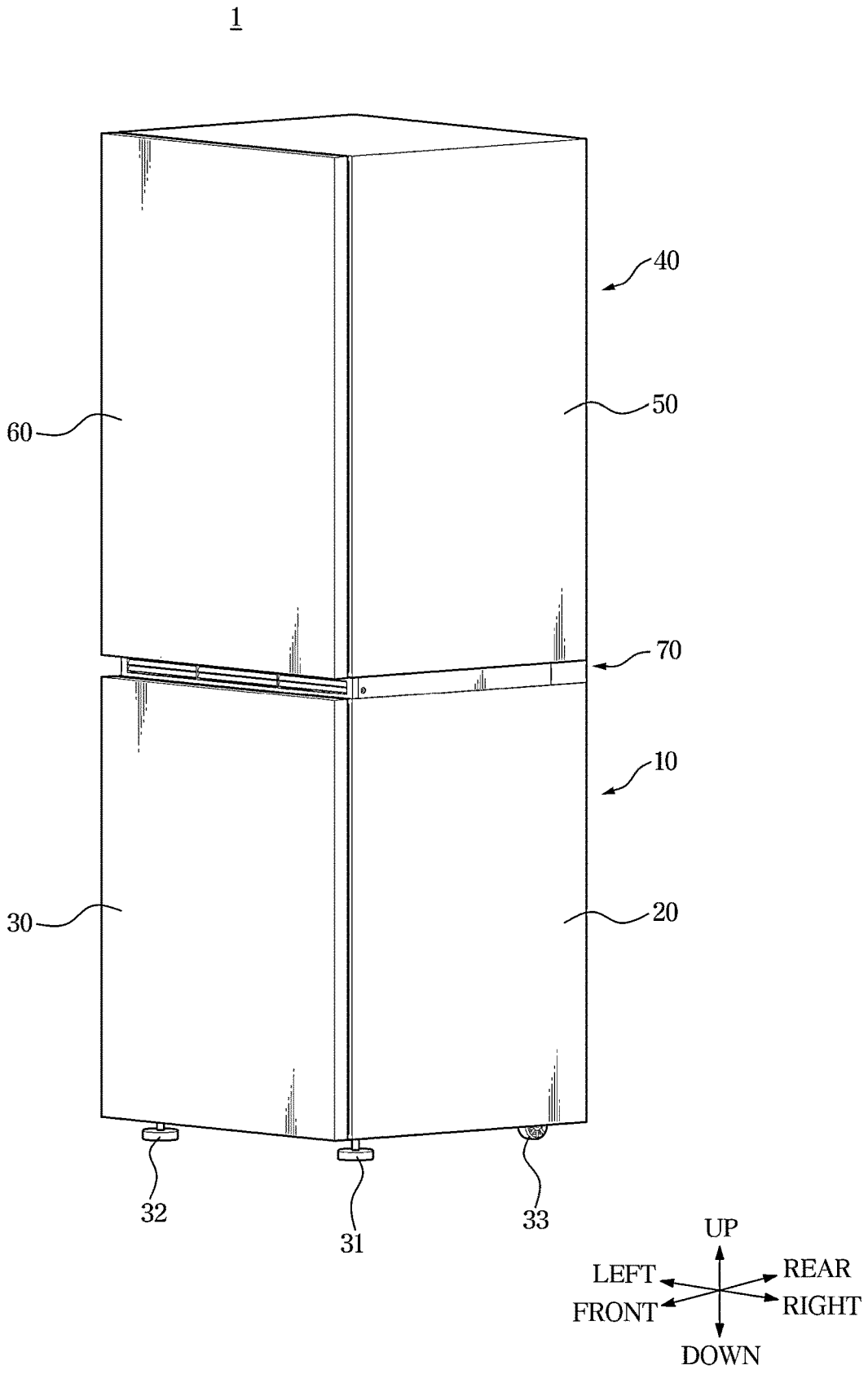
FIG. 1 is a perspective view of a refrigerator according to an embodiment.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

Further, the terminology used herein is for the purpose of describing embodiments and is not intended to limit and/or define the preset disclosure. The singular form of a noun corresponding to an item may include one or a plurality of the items unless clearly indicated otherwise in a related context. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Terms such as "1st", "2nd", "first", or "second" may be used simply to distinguish a component from other components, without limiting the component in other aspects (e.g., importance or order). For example, without departing from the scope of the present disclosure, a first component may be named as a second component, and similarly a second component may be named as a first component. As used herein, the term "and/or" includes any and all combinations of one or more of associated listed items.

Further, as used in the disclosure, the terms "front", "rear", "top", "bottom", "side", "left", "right", "upper", "lower", and the like are defined with reference to the drawings, and are not intended to limit the shape and position of each component.

Hereinafter, an embodiment will be described in detail with reference to the accompanying drawings.

Figure 2:
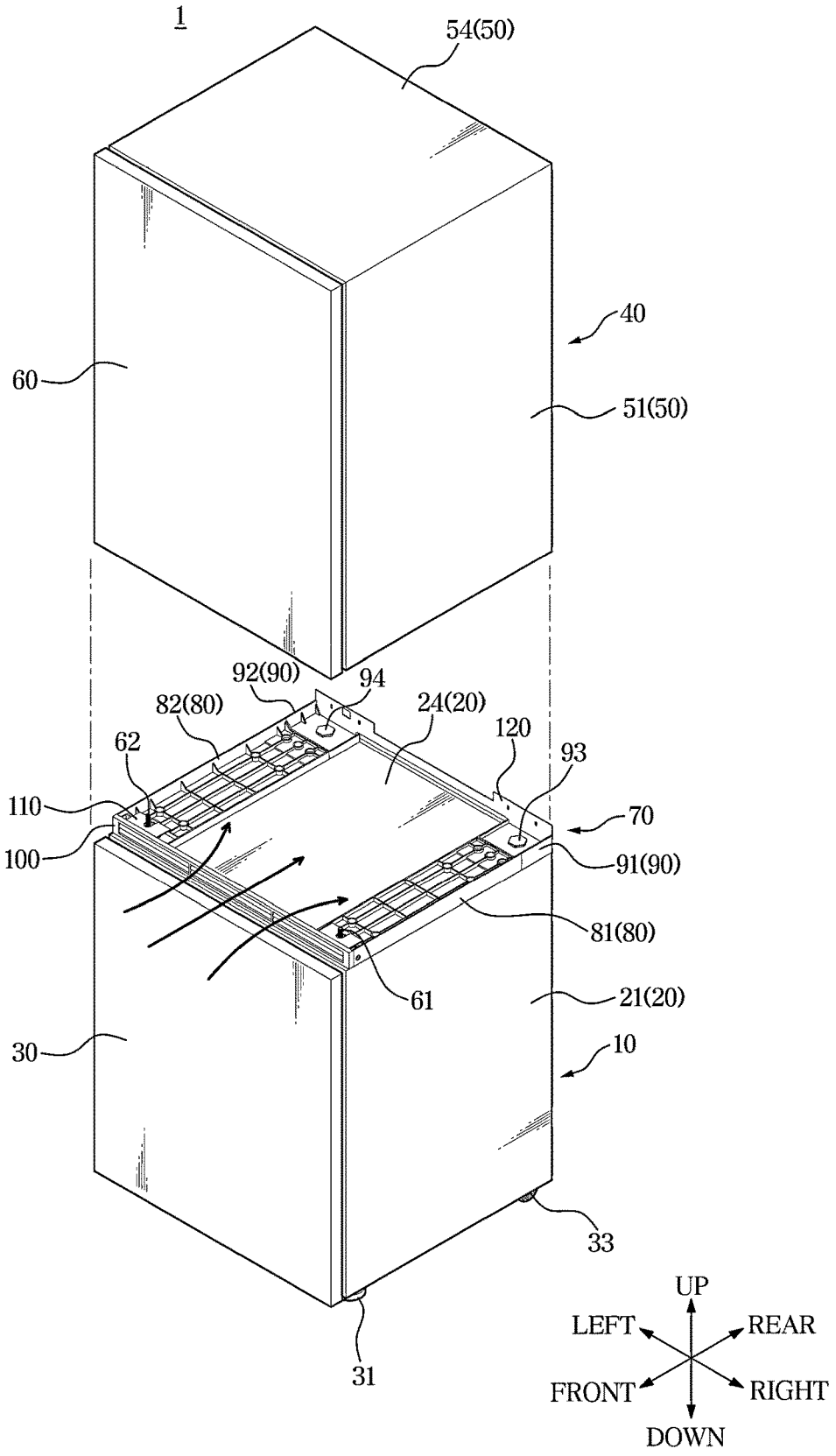
FIG. 2 is a view of a support module after a second refrigerator, according to an example, has been moved upwardly.

Referring to FIGS. 1 and 2, a refrigerator 1 may include a first refrigerator 10 and a second refrigerator 40. The first refrigerator 10 may be referred to as a lower refrigerator, and the second refrigerator 40 may be referred to as an upper refrigerator. The second refrigerator 40 may be positioned on an upper side of the first refrigerator 10.

The first refrigerator 10 may include a main body 20, a storage compartment 26 formed inside the main body 20 (see FIG. 6), a door 30 for opening or closing the storage compartment 26, and a cold air supply device (not shown) for supplying a cold air to the storage compartment. The second refrigerator 40 may include a main body 50, a storage compartment 56 formed inside the main body 50, a door 60 that opens or closes the storage compartment 56, and a cold air supply device that supplies cold air to the storage compartment 56.

The main body 20 of the first refrigerator 10 may include a right wall 21, a bottom wall 22 (see FIG. 10), a left wall 23 (see FIG. 12), and an upper wall 24, and lower wall 24 forming an exterior of the main body 20. The main body 20 of the first refrigerator 10 may also include a right inner surface 21*a*, a bottom inner surface 22*a*, a left inner surface 23*a*, an upper inner surface 24*a*, and a rear inner surface 25*a* forming the storage compartment 26.

Similarly, the main body 50 of the second refrigerator 40 may include a right wall 51, a bottom wall 52, a left wall 53, an upper wall 54, and a rear wall 55 forming an exterior of the main body 50. The main body 50 of the second refrigerator 40 may also include a right inner surface 51*a*, a bottom inner surface 52*a*, a left inner surface 53*a*, an upper inner surface 54*a*, and a rear inner surface 55*a* forming the storage compartment 56.

The main body 20 of the first refrigerator 10 may include an inner case forming the storage compartment 26, an outer case coupled to the outside of the inner case to form an exterior thereof, and a foam insulation 27 foamed between the inner case and the outer case to insulate the storage compartment 26. The main body 40 may include an inner case forming the storage compartment 56, an outer case coupled to the outside of the inner case to form an exterior thereof, and a foam insulation 57 foamed between the inner case and the outer case to insulate the storage compartment 56.

The inner case may be formed by injection molding from a plastic material, and the outer case may be formed from a metallic material. Urethane foam insulation may be used as the foam insulation, and if necessary, a vacuum insulation panel may be used together.

The cold air supply device may generate cold air using a cooling cycle of compressing, condensing, expanding and evaporating a refrigerant.

Legs 31 and 32 may be disposed on a lower side of the first refrigerator 10. A plurality of legs 31 and 32 may be disposed on the floor to support the front of the first refrigerator 10. The legs 31 and 32 may include the first leg 31 disposed on a front right side of the first refrigerator 10 and the second leg 32 disposed on a front left side of the first refrigerator 10. The rear side of the legs 31 and 32 may include casters 33 and 34 arranged on a rear lower side of the first refrigerator 10. The casters 33 and 34 may include the first caster 33 disposed on a rear right side of the first refrigerator 10 and the second caster 34 disposed on a rear left side of the first refrigerator 10.

The refrigerator 1 may include a support module 70. The support module 70 may be arranged to stack the first refrigerator 10 and the second refrigerator 40 on top of each other.

Figure 3:
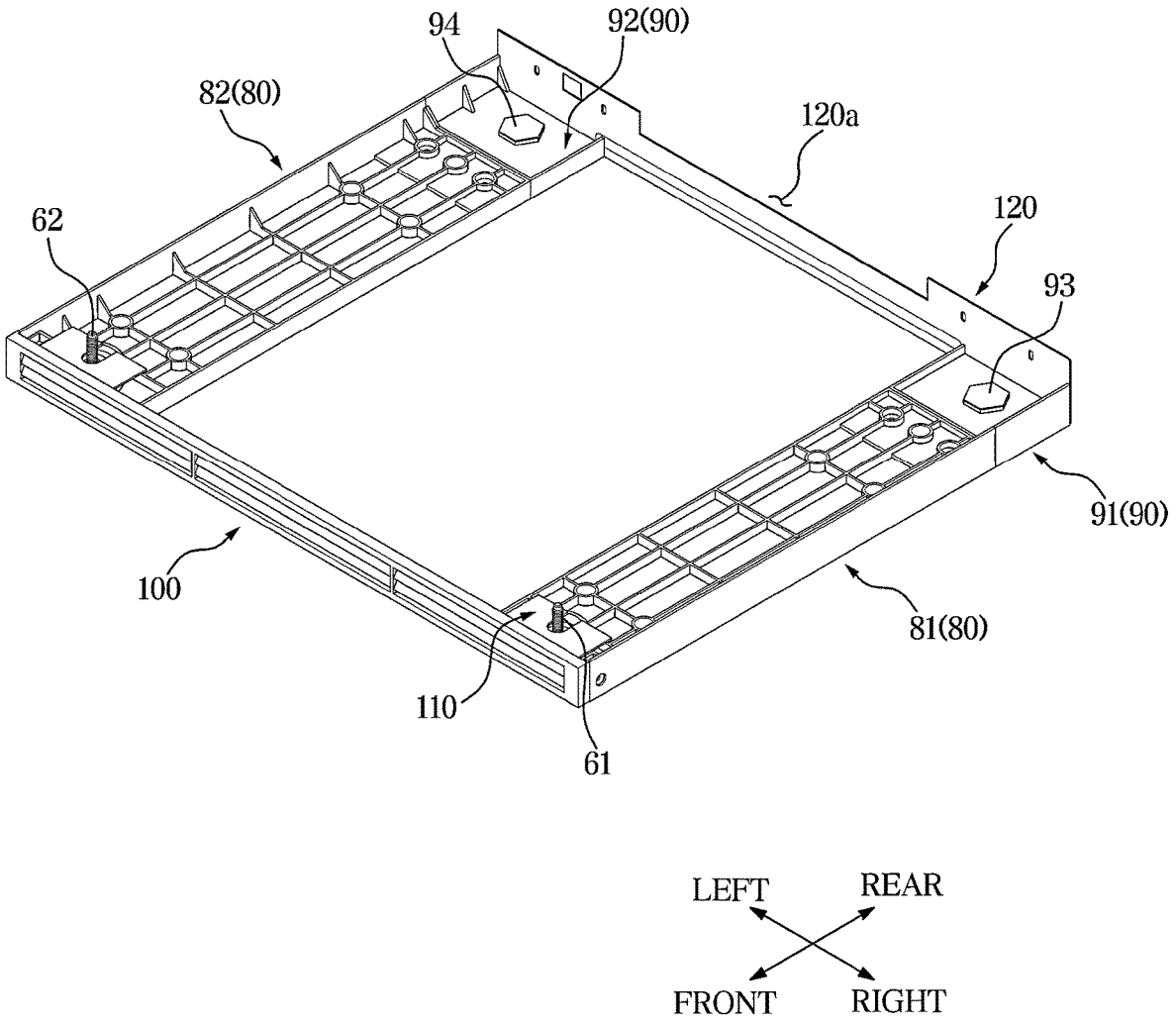
FIG. 3 is a perspective view of the support module shown in FIG. 2.

Referring to FIGS. 2 and 3, the support module 70 may include legs 61 and 62 disposed above the upper wall 24 of the first refrigerator 10. The legs 61 and 62 may include the first leg 61 disposed on a right side of the first refrigerator 10 and a second leg 62 disposed on a left side of the first refrigerator 10.

The support module 70 may include a main plate 80, a front cover 100 disposed in front of the main plate 80, and a guide plate 90 disposed behind the main plate 80.

The main plate 80 may be disposed above the upper wall 24 of the first refrigerator 10 and may extend in a front-to-back direction of the first refrigerator 10. The main plate 80 may include a first main plate 81 disposed on the right side of the first refrigerator 10 and a second main plate 82 disposed on the left side of the first refrigerator 10.

The front cover 100 may be a plate disposed above the upper wall 24 of the first refrigerator 10 and extending in a left-to-right direction of the first refrigerator 10. The front cover 100 may be coupled to the front of the first main plate 81 and the second main plate 82.

More specifically, the front cover 100 may be screw-coupled via holes formed on the left and right sides of the front cover 100 and holes formed on the outer front of the first main plate 81 and the second main plate 82.

A bracket 110 may be arranged between the front cover 100 and the main plate 80 may be to couple the legs 61 and 62. In other words, the bracket 110 may be coupled to the front cover 100 at the front, and the bracket 110 may be coupled to the legs 61 and 62 at the rear.

The support module 70 may include the guide plate 90 disposed on a rear side of the main plate 80 and a fastener 120 disposed on a rear side of the guide plate 90. The guide plate 90 may be disposed above the upper wall 24 of the first refrigerator 10, and may include a first guide plate 91 disposed on the right side of the first refrigerator 10 and a second guide plate 92 disposed on the left side of the first refrigerator 10. The first guide plate 91 may be coupled to the first main plate 81, and the second guide plate 92 may be coupled to the second main plate 82.

The first guide plate 91 may be coupled to a first guide lever 93, and the second guide plate 92 may be coupled to a second guide lever 94.

The fastener 120 may extend in the left-to-right direction of the first refrigerator 10, and may be coupled to the guide plate 90 at a rear side of the first guide plate 91 and the second guide plate 92.

Figure 4:
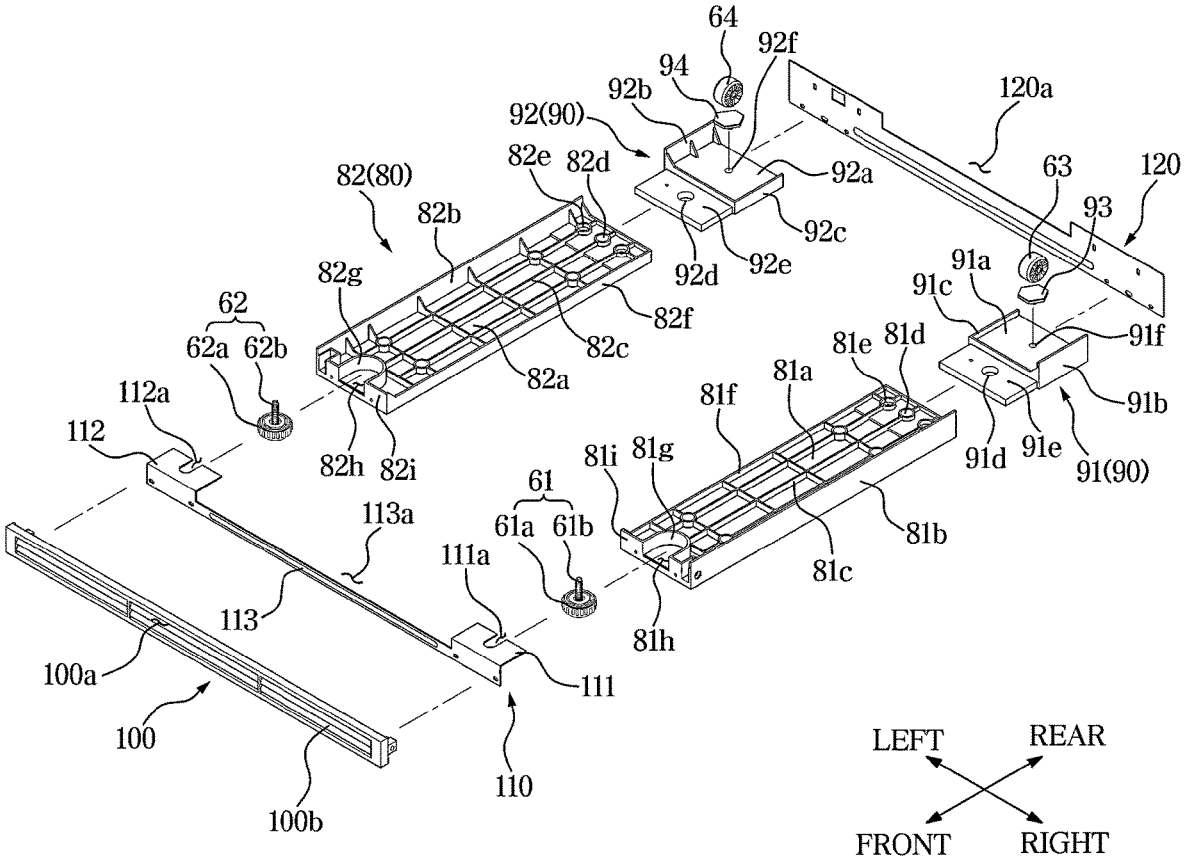
FIG. 4 is an exploded perspective view of the support module and a caster shown in FIG. 3.
Figure 5:
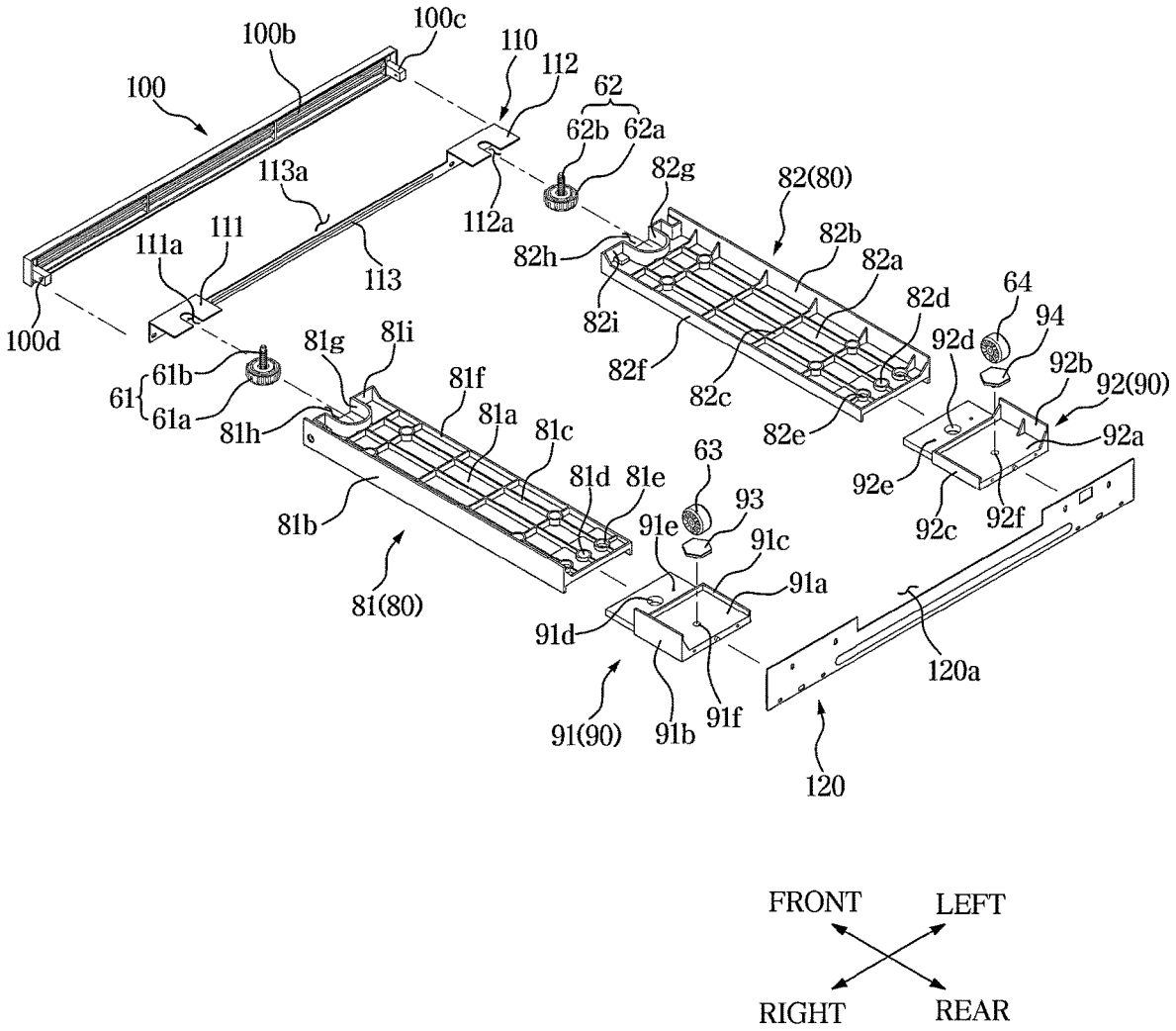
FIG. 5 is an exploded perspective view of the support module and the caster shown in FIG. 4 from a different angle.

Referring to FIGS. 4 and 5, the support module 70 will be described in more detail. The support module 70 may include the main plate 80 extending in the front-to-back direction, the legs 61 and 62 disposed on the front side of the main plate, the bracket 110 securing the legs 61 and 62, and the front cover 100 disposed on the front side of the front cover 100. The support module 70 may also include the guide plate 90 disposed on the rear side of the main plate 80 and the fastener 120 disposed on the rear side of the guide plate 90.

Hereinafter, the first and second legs 61 and 62, the first and second main plates 81 and 82, and the first and second guide plates 91 and 92 will be described in detail with respect to only one of the configurations.

The legs 61 and 62 may include bases 61*a* and 62*a* and leg shafts 61*b* and 62*b* extending upwardly from the bases 61*a* and 62*a*. Of the legs 61 and 62, the first leg 61 disposed on the right side of the first refrigerator 10 may include the first base 61*a* and the first leg shaft 61*b* extending upwardly from the first base 61*a*.

Of the main plates 80, the first main plate 81 disposed on the right side of the first refrigerator 10 may include a first body 81*a* extending in the front-to-back direction and a first outer wall 81*b* extending upwardly from the right side of the first body 81*a*. The first main plate 81 may include a first rib 81*c* protruding upward from the first body 81*a* to reinforce rigidity, and a first insertion protrusion 81*d* protruding toward a rear lower side of the first body 81*a*. A central portion of the first insertion protrusion 81*d* may be provided with a first insertion protrusion hole formed for insertion of a boss.

On the left and right sides of the first insertion protrusion 81*d*, a pair of first recesses 81*e* may be arranged, each including a first recess hole. On the opposite side of the first outer wall 81*b* of the first main plate 81, a first inner wall 81*f* may be arranged extending upwardly from the first body 81*a*, and a height of the first inner wall 81*f* may be lower than that of the outer wall 81*b*.

The first main plate 81 may include a first base wall 81*g* forming a first base groove 81*h* in which the first base 61*a* is received on the front side. The front side of the first base wall 81*g* may be provided with a front wall 81*i* formed to be coupled to the bracket 110. From the front wall 81*i*, the first base wall 81*g* may be formed on the rear side such that the front side is open.

The bracket 110 may have corresponding shapes on the left and right sides. The bracket 110 may include a frame 113 extending to the left and right sides of the first refrigerator 10, and the frame 113 may be formed with a low height at a central portion to form an inlet 113*a* at the central portion.

A first leg shaft wall 111 forming a first leg shaft groove 111*a* in which the first leg shaft 61*b* is received may be formed on the right side of the frame 113. A second leg shaft wall 112 forming a second leg shaft groove 112*a* in which the second leg shaft 62*b* is received may be formed on the left side of the frame 113. The first leg shaft wall 111 and the second leg shaft wall 112 may be formed to be open toward the rear side. On the left and right sides of the frame 113, a hole may be arranged to be coupled to the second front wall 82*i* and the first front wall 81*i*, respectively.

The front cover 100 may be disposed on a front side of the bracket 110. The front cover 100 may be a plate extending from side to side, and protrusions 100*c* and 100*d* protruding backwardly may be disposed on the left and right sides of the front cover 100. Each of the protrusions 100*c* and 100*d* may include a hole formed to correspond to each of the holes formed on the front side of the first outer wall 81*b* and a second outer wall 82*b*. In other words, the first main plate 81 may include the first front wall 81*i* and the first outer wall 81*b* spaced apart, and the protrusion 100*d* of the front cover 100 may be inserted into the spaced space and screw-coupled thereto. The same may be applied to the second main plate 82 and the protrusion 100*c*.

The front cover 100 may include a blade 100*b* extending from side to side at the front. The blade 100*b* may be formed integrally, or may be separated into a plurality of pieces along the top, bottom, left, and right sides. The blades 100*b* may form an opening 100*a*. Air from the front may flow in through the opening 100*a* and into a space between the first refrigerator 10 (see FIG. 2) and the second refrigerator 40 through the inlet 113*a*.

The first guide plate 91 disposed on the right side of the guide plates 90 may include a first body 91*a* and a first outer wall 91*b* extending upwardly from the first body 91*a* to cover the right side. The first guide plate 91 may have a first inner wall 91*c* extending upwardly from the first body 91*a* in a direction toward the interior of the first refrigerator 10 opposite to the first outer wall 91*b*. The first inner wall 91*c* may be formed to extend in an L-shape from the opposite side of the first outer wall 91*b* of the first body 91*a* so as to space the front and rear of the first body 91*a*. The first inner wall 91*c* may act as a rib to increase the rigidity of the first body 91*a*.

The first outer wall 91*b* of the first guide plate 91 may correspond to the height of the first outer wall 81*b* of the first main plate 81, and the first inner wall 91*c* of the first guide plate 91 may correspond to the height of the first inner wall 81*f* of the first main plate 81.

The first guide plate 91 may include a first insertion hole 91*d* formed in the center disposed on the front side, and first front holes 91*e* formed one by one on the left and right sides of the first insertion hole 91*d*. The first insertion hole 91*d* may be formed to be larger than the size of a pair of the first front holes 91*e*. The first insertion hole 91*d* may be formed to allow the first insertion protrusion 81*d* of the first main plate 81 to be inserted, and may be coupled to the upper wall 24 of the first refrigerator 10 through a coupling member, such as a boss. The pair of first front holes 91*e* may correspond in size to the pair of first recesses 81*e* of the first main plate 81, and may be coupled to the upper wall 24 of the first refrigerator 10 through a coupling member, such as a screw.

A first coupling hole 91*f* formed in the first body 81*a* may be formed on the rear side of the first guide plate 91. The first guide lever 93, which is disposed on the right side of the guide levers 93 and 94, may be formed to be inserted into the first coupling hole 91*f*. The first guide lever 93 may support the first caster 63 from a downward side.

The guide plate 90 may be arranged to support the casters 63 and 64 coupled to a lower side of the second refrigerator 40. The casters 63 and 64 may include the first caster 63 disposed on a right side of the second refrigerator 40 and a second caster 64 disposed on a left side of the second refrigerator 40. The first guide plate 91 may be disposed on a lower side of the first caster 63 to support the second refrigerator 40, thereby supporting the first caster 63. Similarly, the second guide plate 92 may support the second refrigerator 40 by supporting the second caster 64 on a lower side of the second caster 64.

The fastener 120 may be disposed on the rear side of the first guide plate 81. The fastener 120 may extend from side to side and form an outlet 120*a* at the center thereof. Air entering the space between the first refrigerator 10 and the second refrigerator 40 through the opening 100*a* and the inlet 113*a* may be discharged to the outside through the outlet 120*a* after being heat exchange with the second refrigerator 40. On the left and right sides of the fastener 120, holes may be formed to be coupled to the guide plates 91 and 92.

Figure 6:
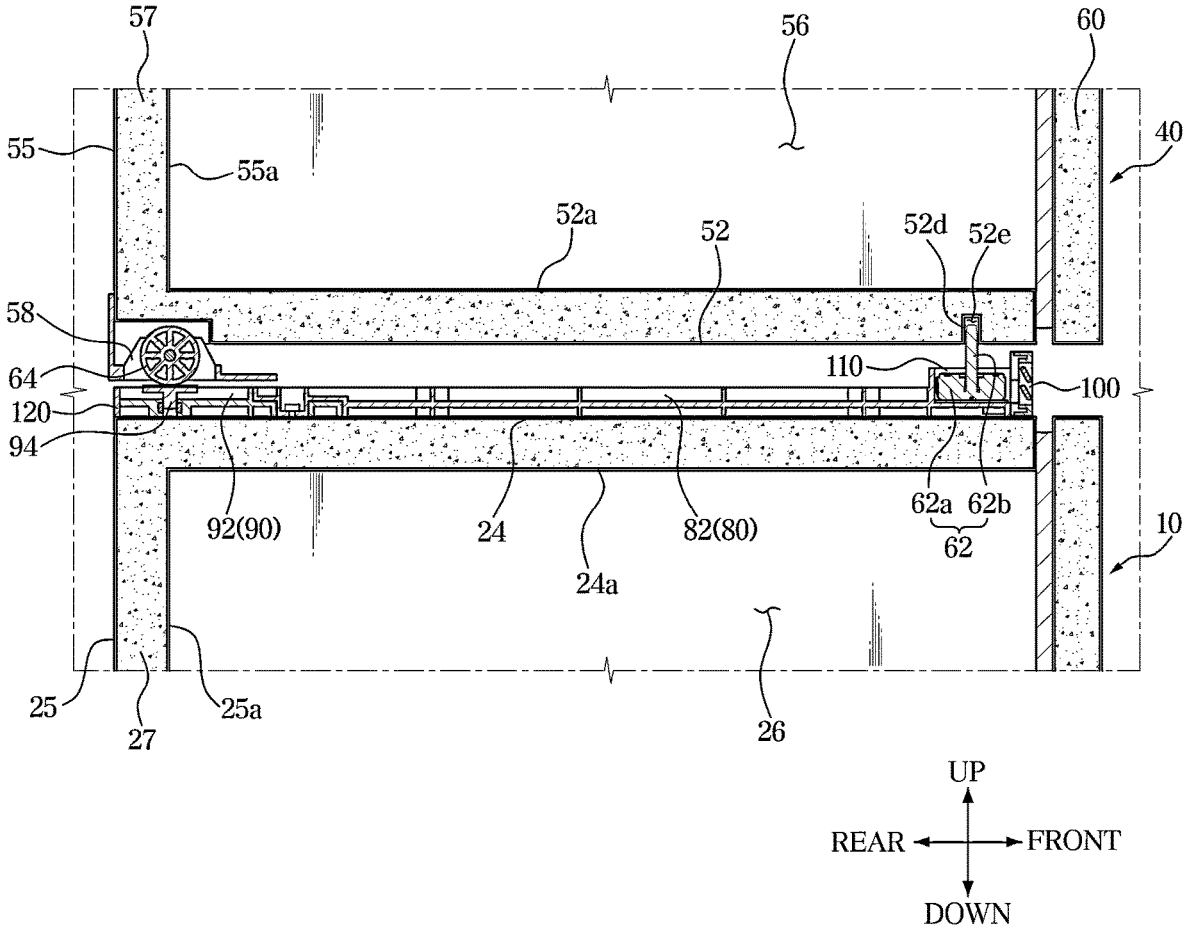
FIG. 6 is an enlarged side sectional view of the coupled view of the support module, a first refrigerator and the second refrigerator.

Referring to FIG. 6, the second refrigerator 40 may include a bottom inner wall 52*d* to form a leg groove 52*e* upwardly from the bottom wall 52. The bottom inner wall 52*d* may be formed one on each front left and right side. The lower side of the first refrigerator 10 may be correspondingly formed. The second leg shaft 62*b* and the bottom inner wall 52*d* may have the form of male and female threads.

The second refrigerator 40 may include a caster coupling plate 58 coupled to the bottom wall 52 and the rear wall 55 disposed on the rear side. The caster coupling plate 58 may have an L-shape and may be coupled to the shafts of the casters 63 and 64 (see FIG. 12). The second caster 64 may be supported by the second guide lever 94. The second guide lever 94 may be inserted into the second guide plate 92.

Figure 7:
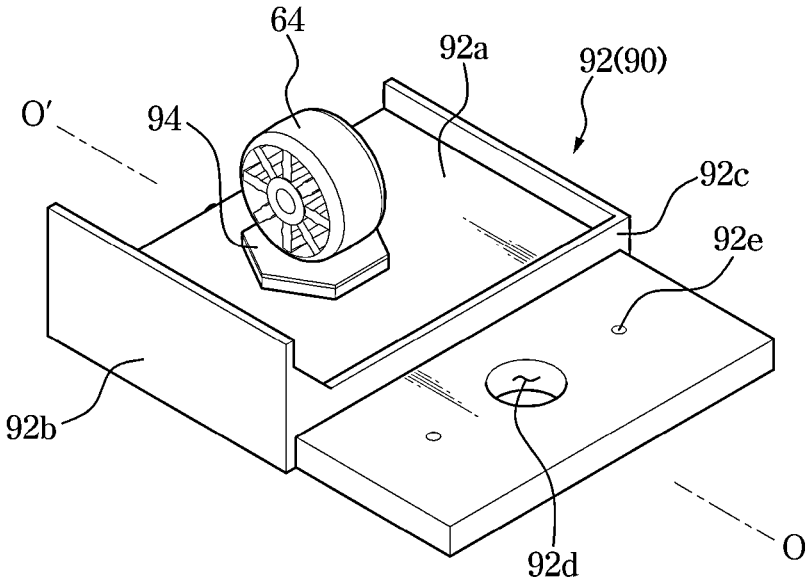
FIG. 7 is an enlarged view of the second caster, a second guide lever, and a second guide plate shown in FIG. 4 coupled together.
Figure 8:
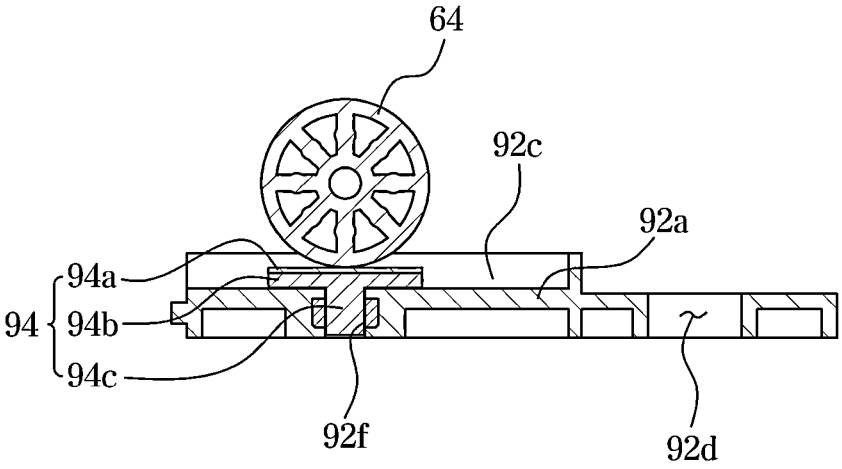
FIGS. 8 and 9 are side cross-sectional views showing the guide lever shown in FIG. 7 being movable up and down.
Figure 9:
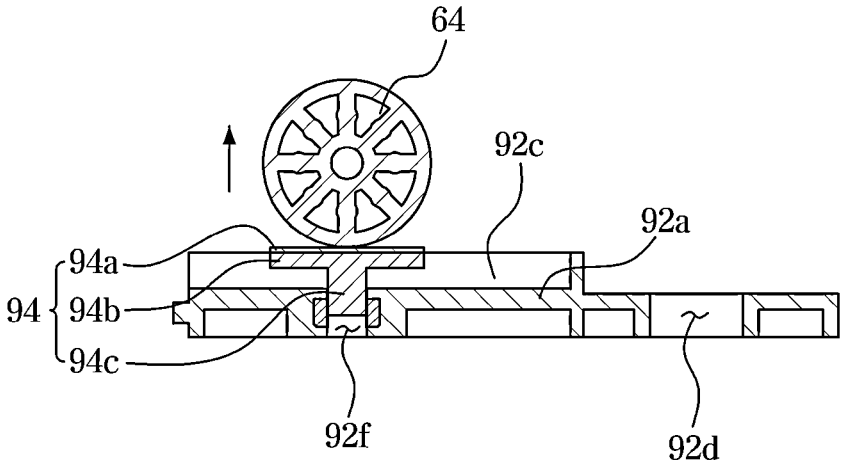

FIG. 7 is a view showing the second caster 64, the second guide lever 94, and the second guide plate 92 coupled together. FIGS. 8 and 9 are side cross-sectional views showing the coupled feature of the second caster 64 and the second guide plate 92 when the second guide lever 94 is positioned in a low position and a high position, respectively.

With reference to FIGS. 7 to 9, the coupling relationship between the second caster 64, the second guide lever 94, and the second guide plate 64 will be described in detail, and the coupling relationship between the first caster 63 (see FIG. 12), the first guide lever 93 and the first guide plate 91 may also be described correspondingly. The second guide lever 94 may be disposed on the lower side of the second caster 64, and the second guide lever 94 may be supported by the second guide plate 92.

The second guide lever 94 may include a second seating member 94*a* on which the second caster 64 is seated, and second rotating members 94*b* and 94*c* coupled to the second seating member 94*a* at a lower side of the second seating member 94*a*.

The second rotating members 94*b* and 94*c* may include the second rotating plate 94*b* and the second rotating shaft 94*c* that rotates correspondingly according to the rotation of the second rotating plate. The second rotating plate 94*b* may be bonded to the second seating member 94*a* using an adhesive, such as a bonding agent. The second seating member 94*a* and the second rotating plate 94*b* may have the shape of a hexagonal plate, but is not limited thereto.

The second rotating shaft 94*c* of the second guide lever 94 may be rotatably inserted into a second coupling hole 92*f* of the second guide plate 92. In other words, although not shown in the drawings, the inner walls of the second rotating shaft 94*c* and the second coupling hole 92*f* may have male and female threads. A user may rotate the side surfaces of the second rotating plate 94*b* and the second seating member 94*a* using a member such as a hexagonal wrench. As the second rotating plate 94*b* and the second seating member 94*a* are rotated, the second rotating shaft 94*c* is rotated, so that the second guide lever 94 may be moved up and down while being rotated.

The second seating member 94*a* may be made of a material, such as rubber, such that the second seating member is in friction with the second caster 64. Such friction may cause the second caster 64 to rotate as the second guide lever 94 rotates, and the second caster 64 may be coupled to the caster coupling plate 58 (see FIG. 6) such that the second caster 64 may rotate a predetermined angle.

With reference to FIGS. 10 to 13, the principle by which the inclination of the second refrigerator 40 is adjusted depending on the support module 70 according to an embodiment will be described in detail. When the second refrigerator 40 is positioned on top of the first refrigerator 10, there may be cases in which the inclination of the second refrigerator 40 occurs in the front-to-back direction and the left-to-right direction due to an impact caused by the door 60 of the second refrigerator 40 or other circumstances.

In this case, the user may move forward the first refrigerator 10 and the second refrigerator 40, which are stacked on a furniture cabinet, or the like, and then disassemble the fastener 120 coupled between the rear side of the first refrigerator 10 and the second refrigerator 40. With the space created by the disassembled fastener 120, the user may rotate the guide levers 93 and 94 disposed on the lower side of the casters 63 and 64 at the rear to a predetermined angle by means of a hexagonal wrench or the like. In this case, the second refrigerator 40 and the first refrigerator 10 may each be mounted to allow the front to be inclined by 0.1 degree more than the rear in the front-to-back direction. This is to ensure that the doors 30 and 60 require less user effort to close, for example by gravity or the like.

Figure 10:
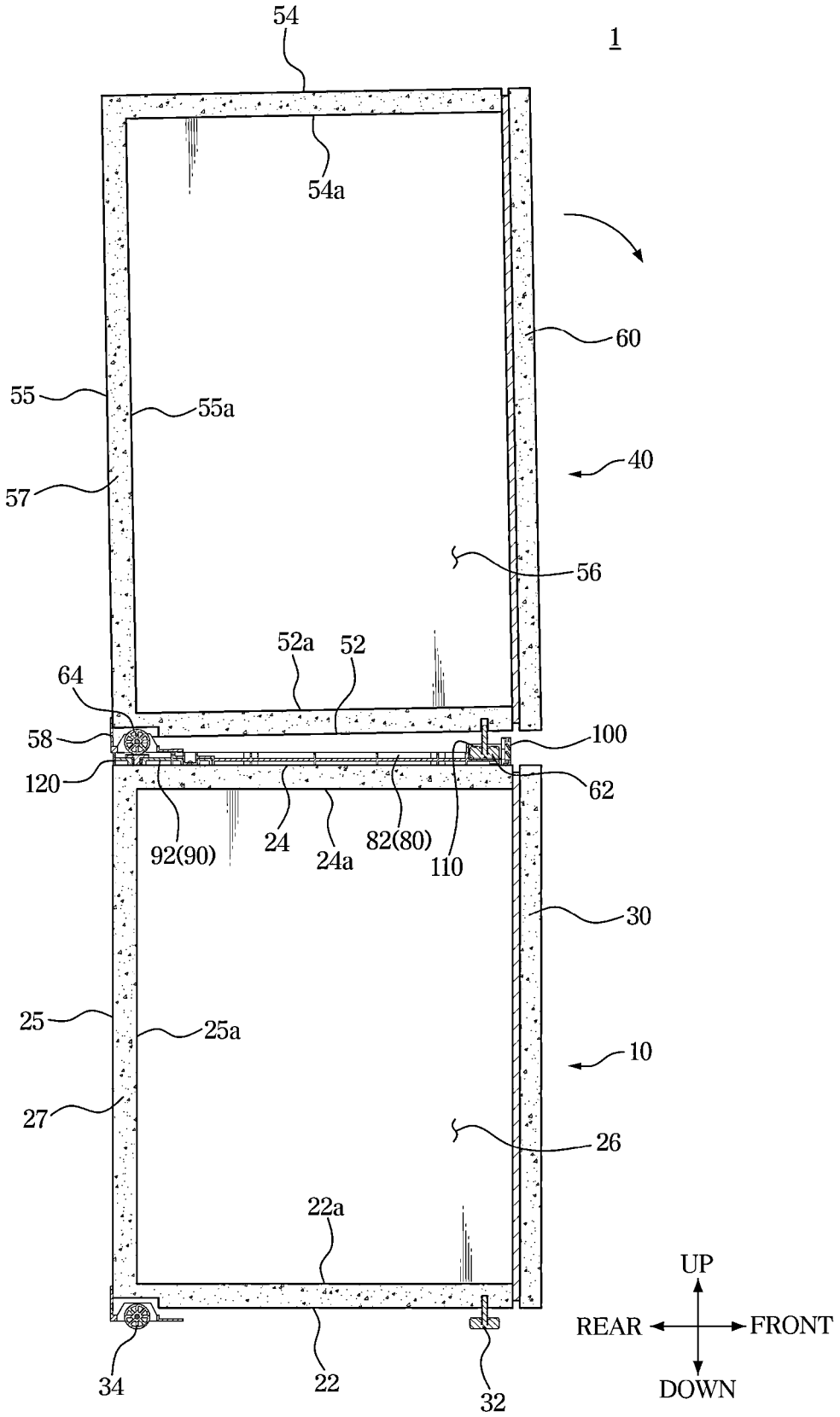
FIGS. 10 and 11 are side views illustrating the adjustment of a step in a front-to-back direction of the first refrigerator and the second refrigerator.
Figure 11:
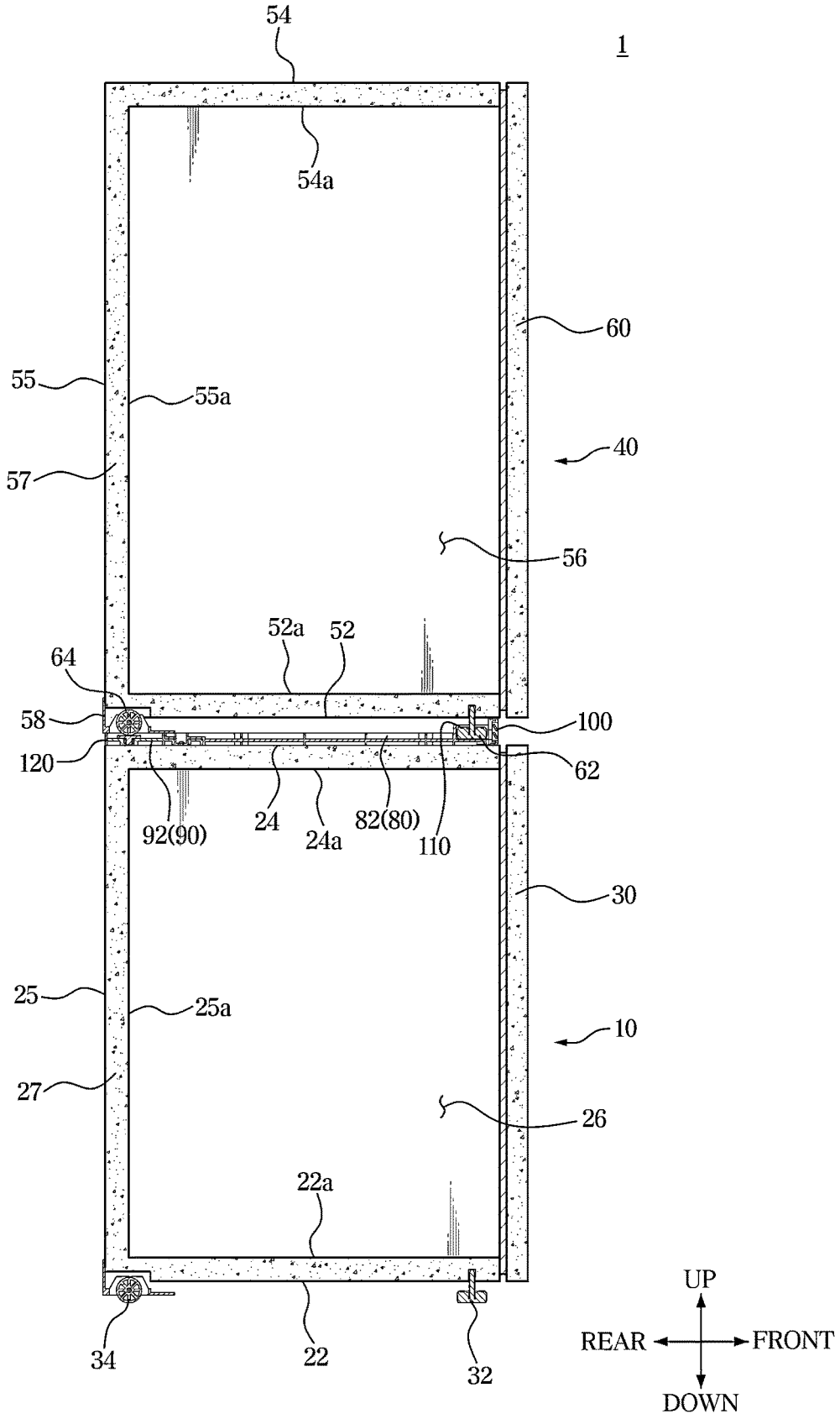

In a case where the second refrigerator 40 is inclined or lowered by more than 0.1 degree in the front-to-back direction of the first refrigerator 10, the casters 63 and 64 may be moved up and down as shown in FIGS. 10 and 11 to adjust the predetermined inclination.

Figure 12:
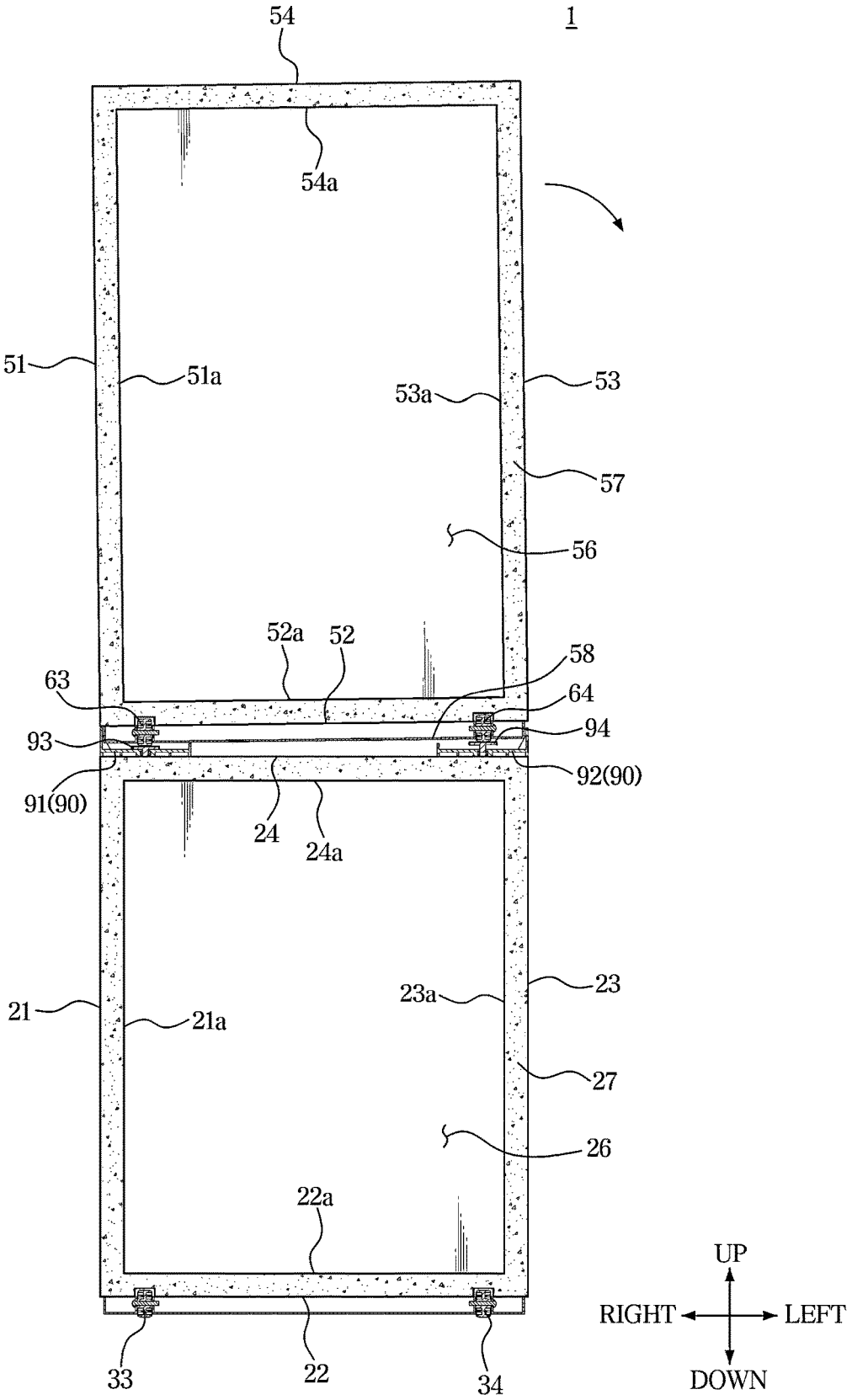
FIGS. 12 and 13 are cross-sectional views illustrating the adjustment of the step in the side-to-side direction of the first refrigerator and the second refrigerator.
Figure 13:
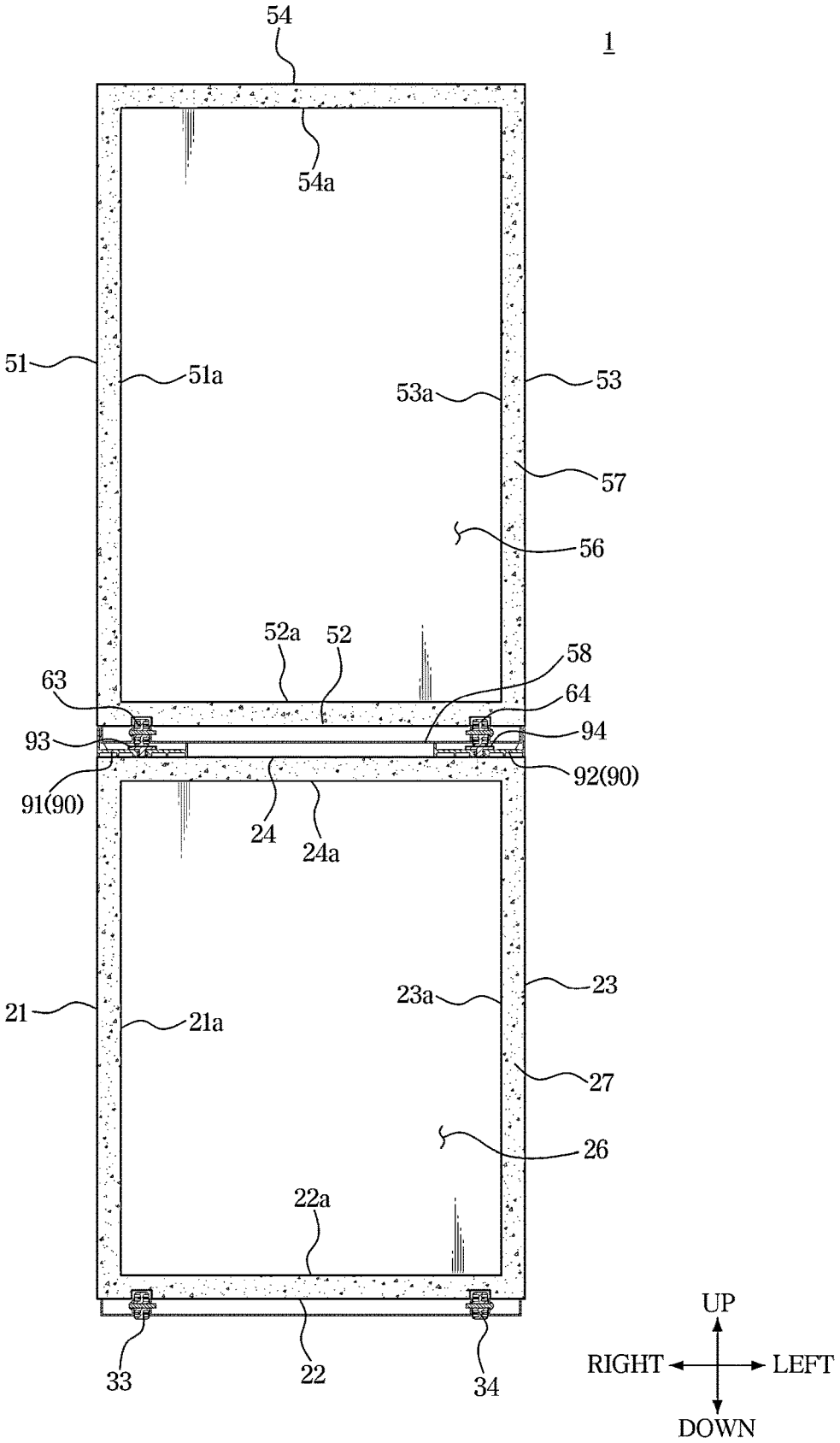

In another case, when the second refrigerator 40 is inclined in the left-to-right direction of the first refrigerator 10, one of the casters 63 and 64 may be adjusted as shown in FIGS. 12 and 13 to adjust the inclination of the second refrigerator 40 in the left-to-right direction.

Such a structure may allow the user to adjust the left-to-right and front-to-back inclinations of the stacked first refrigerator 10 and second refrigerator 40 without disassembling the entire first refrigerator 10 and second refrigerator 40.

Figure 14:
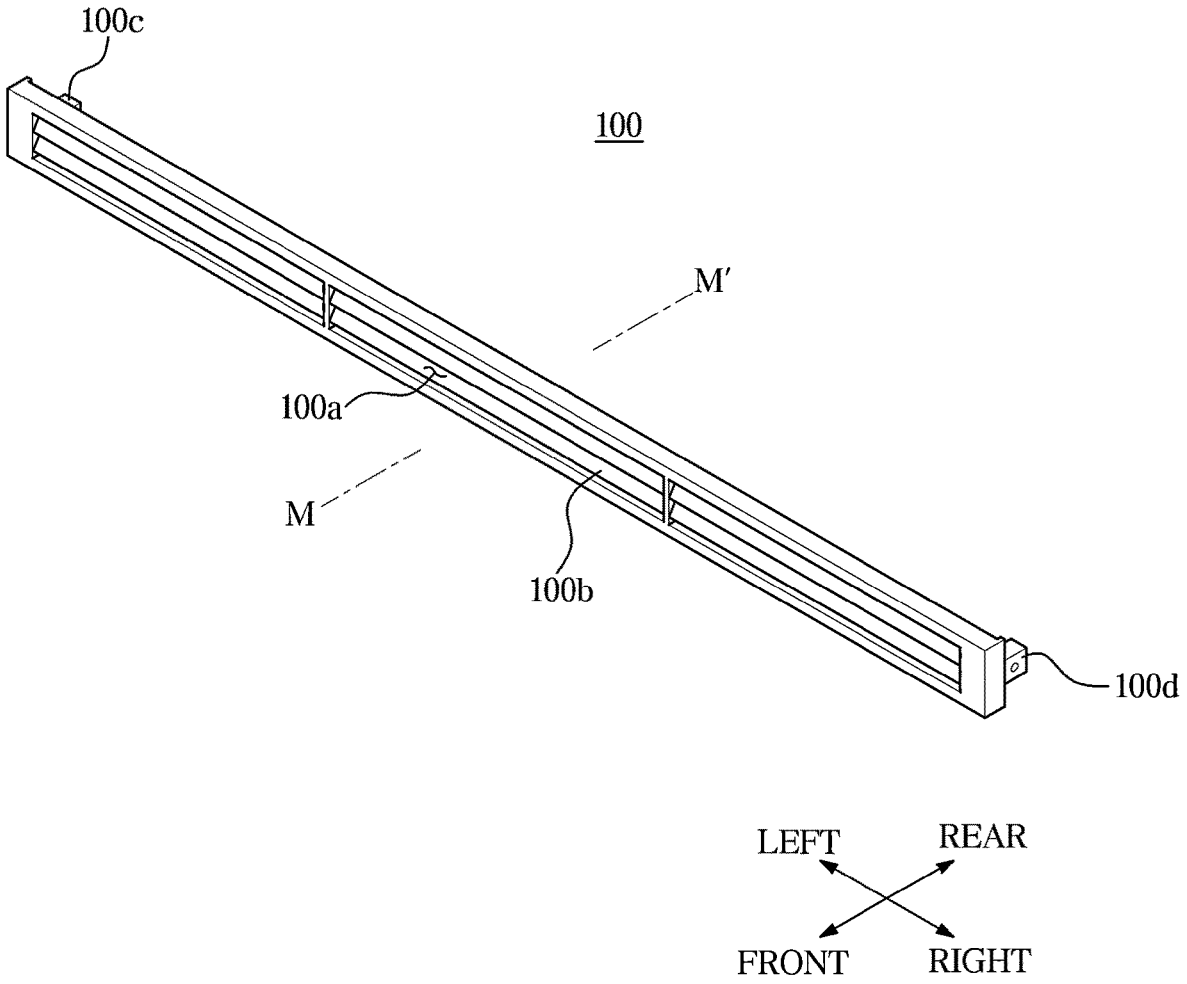
FIG. 14 is an enlarged perspective view of a front cover shown in FIG. 4.
Figure 15:
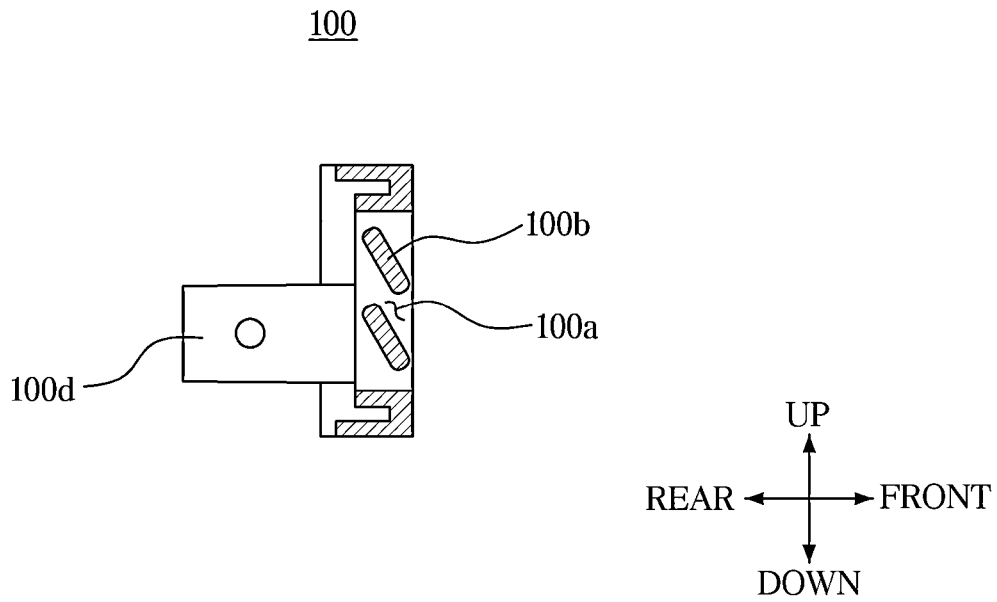
FIG. 15 is a side cross-sectional view of the front cover along the line M-M' shown in FIG. 14.

With reference to FIGS. 2 and 14 to 16, the front cover 100 will be described in detail. FIG. 15 is a side cross-sectional view of the front cover 100 taken along the line M-M' in FIG. 14.

The front cover 100 may be in the form of a plate extending in the left-to-right direction, and may include the blade 100*b* arranged to form the opening 100*a* at the front. As shown in the drawings, the blades 100*b* may be divided into three in the left-to-right direction and two in the up and down direction, but are not limited thereto.

The blades 100*b* of the front cover 100 may form the opening 100*a* arranged to flow air from the front into the space between the first refrigerator 10 and the second refrigerator 40. The blades 100*b* may be mounted to be inclined upwardly as they extend rearwardly. Such a structure may allow the front air flowing in through the opening 100*a* of the obliquely installed blade 100*b* to be guided upwardly and flow into the space between the first refrigerator 10 and the second refrigerator 40. In other words, despite the height of the support module 70 disposed between the first refrigerator 10 and the second refrigerator 40, the air flowing in from the front may be guided to the second refrigerator 40, so that heat exchange with the second refrigerator 40 may be performed smoothly, and noise or power loss may be reduced.

Figure 16:
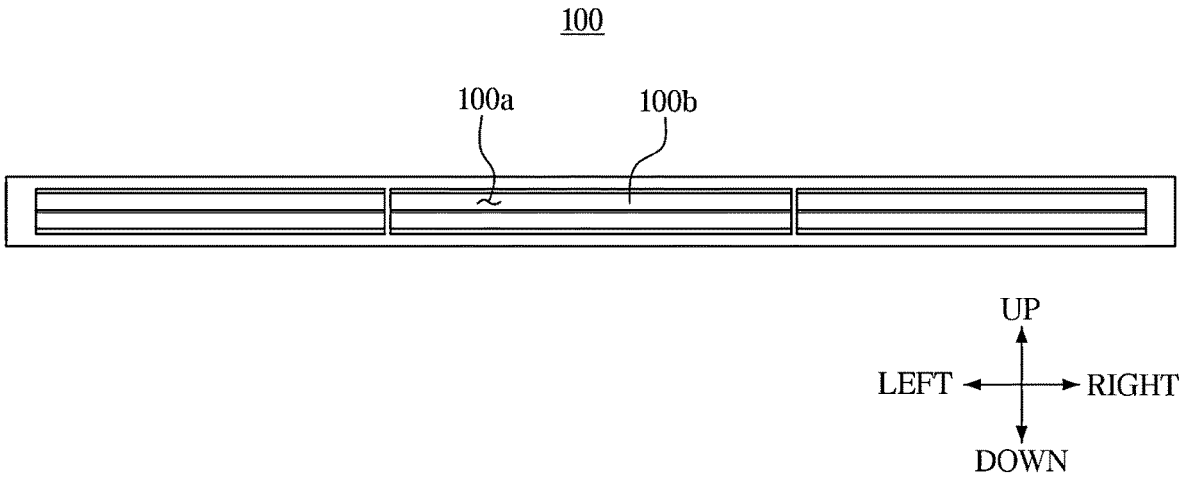
FIG. 16 is a front view of the front cover shown in FIG. 14.
Figure 17:
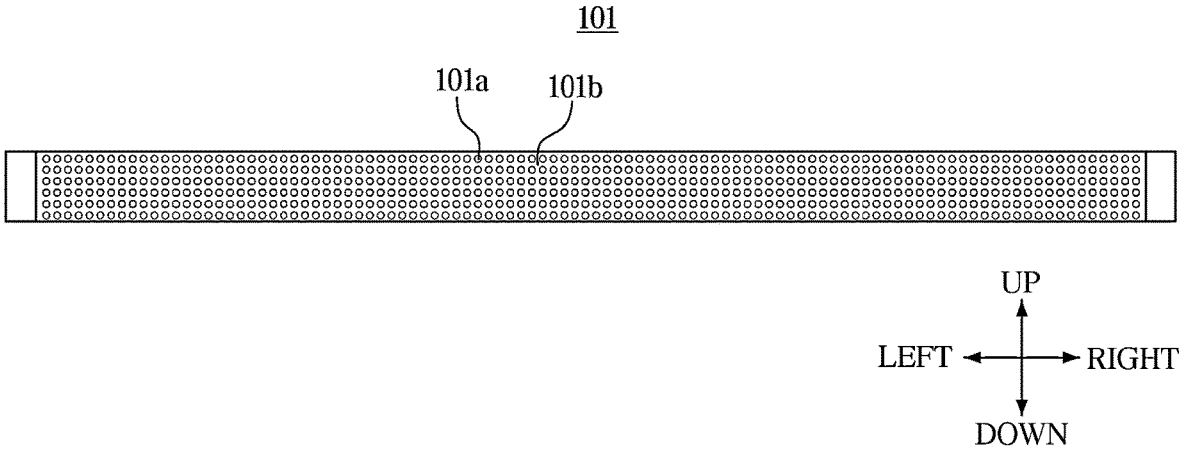
FIGS. 17 and 18 are front views of other shapes of the front cover.
Figure 18:
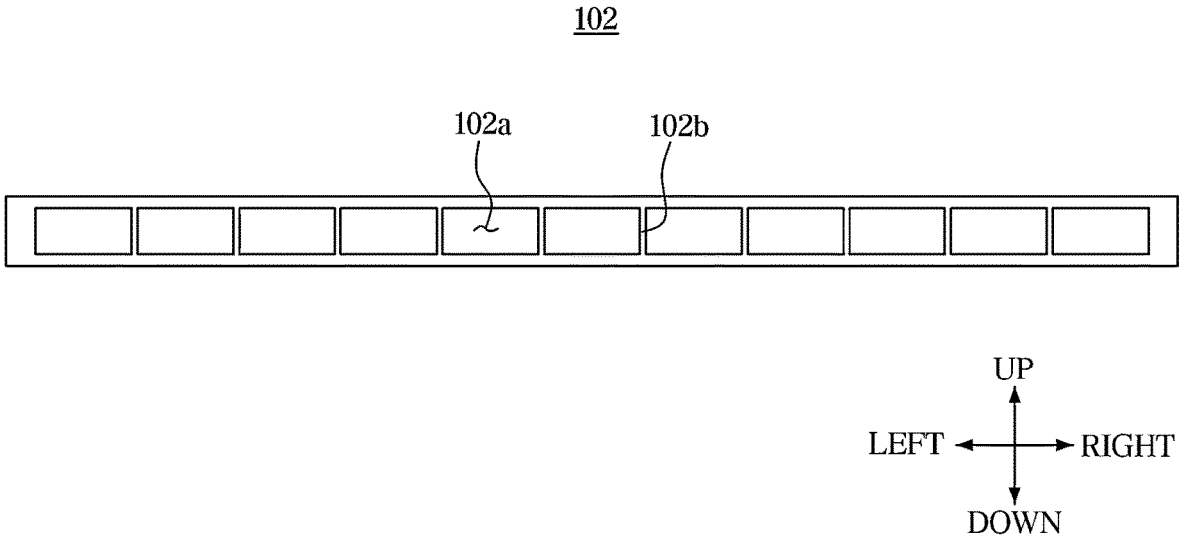

FIGS. 17 and 18 are front views showing the front covers 101 and 102 with different shapes to the front cover 100 of FIGS. 14 to 16 with inclined shapes.

Referring to FIG. 17, the front cover 101 may include a front frame 101*b* including a plurality of openings 101*a*. The plurality of openings 101*a* may allow air to flow through the front cover 101 into the space between the first refrigerator 10 (see FIG. 2) and the second refrigerator 40.

Referring to FIG. 18, the front cover 102 may include a frame 102*b* forming openings 102*a*. Air from the front may flow into the space between the first refrigerator 10 and the second refrigerator 40 through the openings 102*a*.

Figure 19:
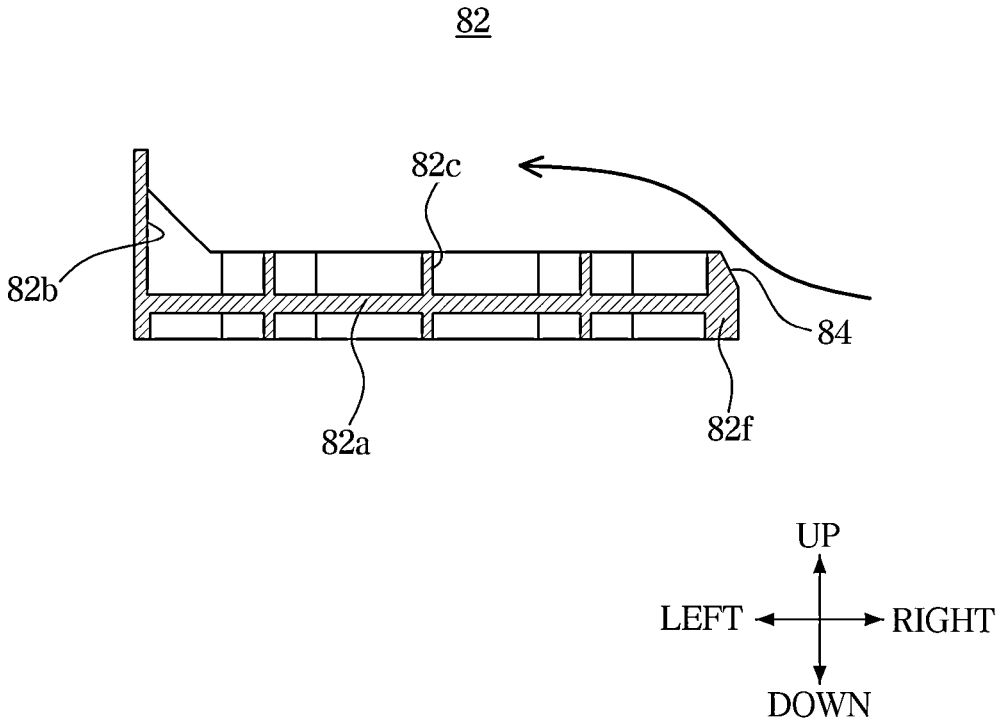
FIG. 19 is a side cross-sectional view of a second main plate including an inclined surface.

FIG. 19 is a side cross-sectional view of the second main plate 82 including an inclined surface. Referring to FIGS. 2 and 19, the second main plate 82 may include the second outer wall 82*b* extending upwardly and downwardly on the left side with respect to a second body 82*a* and a second inner wall 82*f* extending upwardly and downwardly on the right side with respect to the second body 82*a*. The second outer wall 82*b* may be higher than the second inner wall 82*f*, and may be arranged to cover a gap between the left side of the first refrigerator 10 and the second refrigerator 40. In other words, the second outer wall 82*b* may be formed as high as a distance between the first refrigerator 10 and the second refrigerator 40. The first main plate 81 may have a symmetrical shape with the second main plate 82. Such a structure may allow both sides of the space between the first refrigerator 10 and the second refrigerator 40 to be covered, thereby preventing air entering from the front from escaping to both sides. As a result, heat exchange between the air and the second refrigerator 40 may be more smoothly achieved.

Furthermore, a second inclined surface 84 sloping upwardly to the left may be disposed on an upper side of the second inner wall 82*f*. Due to the structure of the second inclined surface 84, air flowing in from the front may be guided upwardly to the left and right rather than sinking to a lower side of the support module 70, thereby allowing air to flow into the lower side of the second refrigerator 40.

Figure 20:
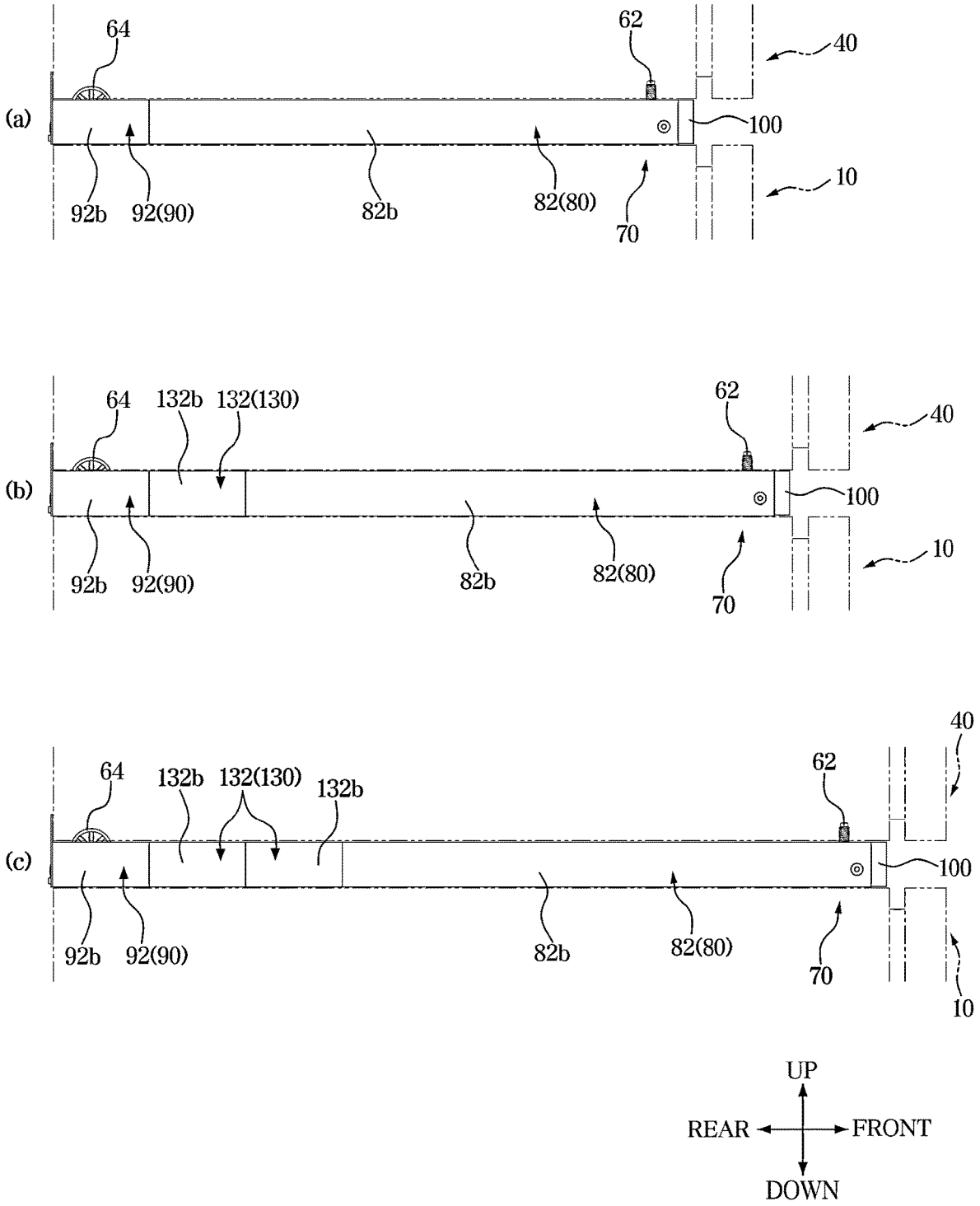
FIGS. 20A to 20C are views illustrating support modules according to the number of sub-plates.

FIGS. 20A to 20C are schematic views showing the support module 70, wherein the size of the support module 70 may be varied depending on the size of the first refrigerator 10 and the second refrigerator 40.

FIG. 20A shows the support module 70 without a sub-plate 130 added to the support module 70, FIG. 20B shows one sub-plate 130 coupled between the main plate 80 and the guide plate 90, and FIG. 20C shows the two sub-plates 130 coupled between the main plate 80 and the guide plate 90.

The sub-plate 130 may be arranged to be coupled between the main plate 80 and the guide plate 90 depending on the situation. Accordingly, although the sizes of the refrigerators are different, the inclination between the upper and lower refrigerators may be adjustable and stackable in the left-to-right and front-to-back directions due to the structure of the support module 70.

The sub-plate 130 may include a first sub-plate couplable to the first main plate 81 (see FIG. 3) and a second sub-plate 132 couplable to the second main plate 82. The second sub-plate 132 may be coupled with the second main plate 82 at the front, and may be coupled with the second guide plate 92 at the rear, as well as with another second sub-plate 132.

Figure 21:
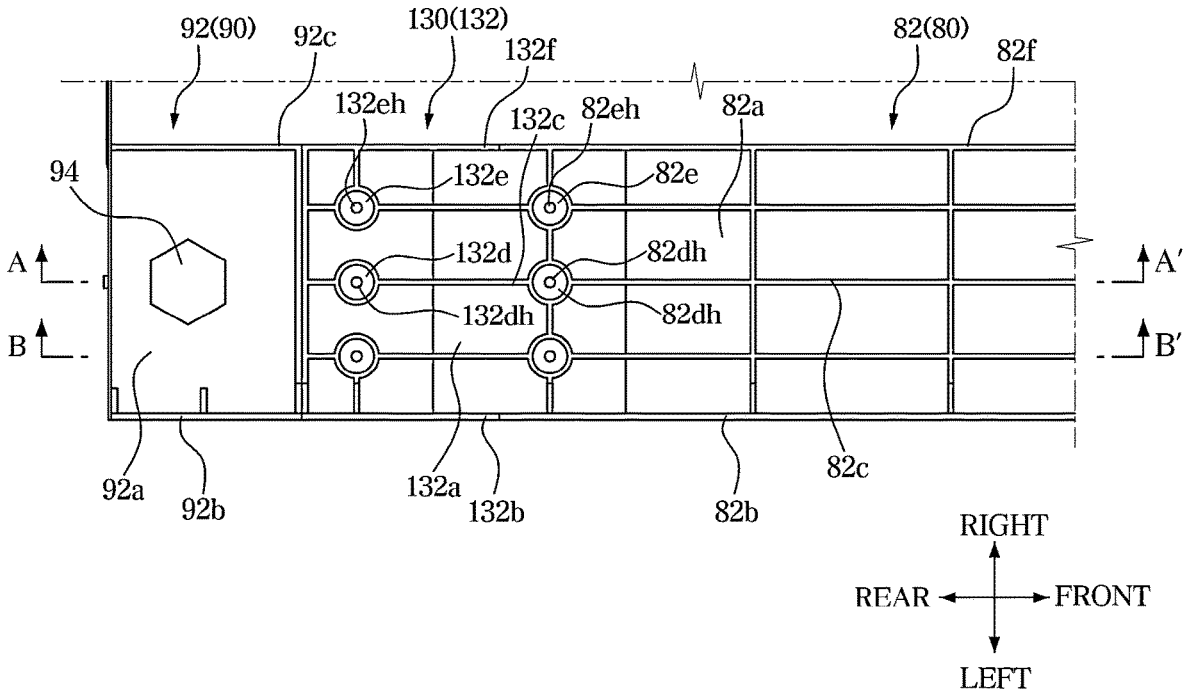
FIG. 21 is a plan view illustrating a coupled feature of the guide plate, the sub-plate and the main plate in a state where one sub-plate according to FIG. 20B is added.
Figure 22:
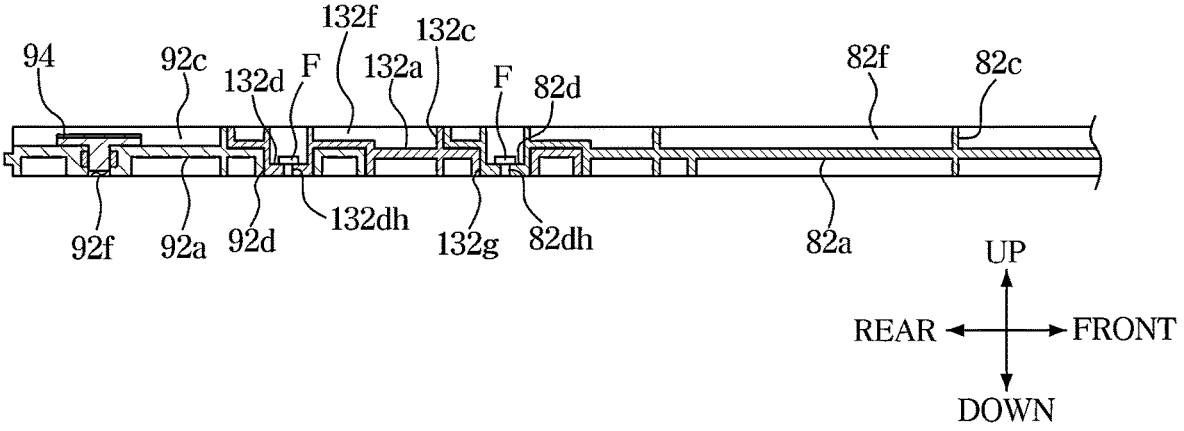
FIG. 22 is a cross-sectional view taken along the line A-A' shown in FIG. 21.
Figure 23:
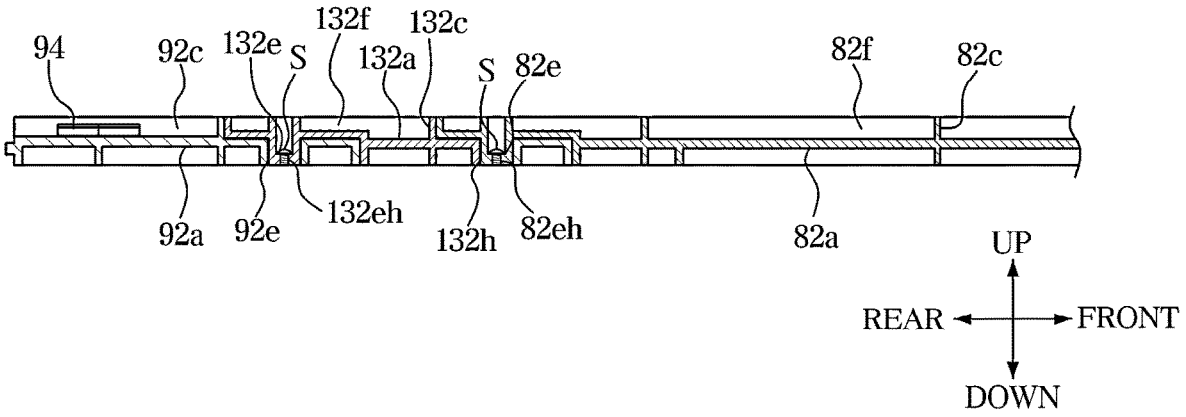
FIG. 23 is a cross-sectional view taken along the line B-B' shown in FIG. 21.
Figure 24:
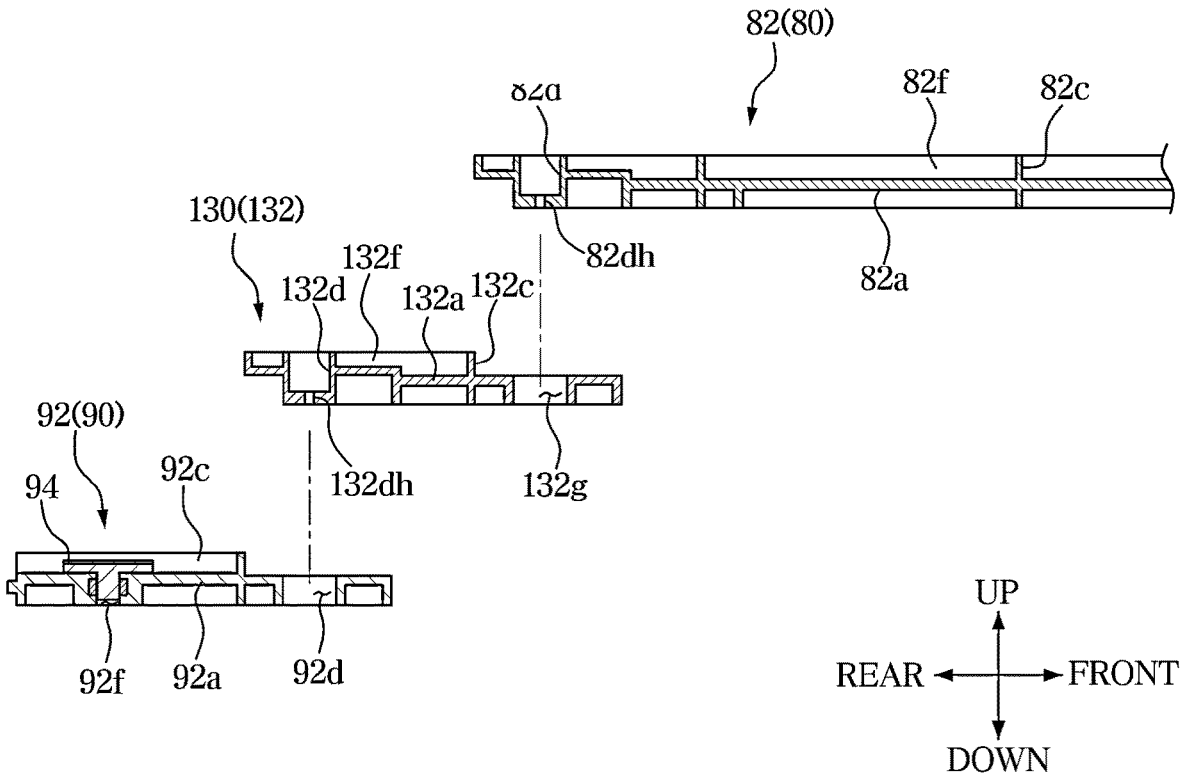
FIG. 24 is an exploded view of a side-section of the guide plate, the sub-plate, and the main plate shown in FIG. 21.

FIG. 21 is a plan view showing one sub-plate 130 according to FIG. 20B added to the support module 70. FIG. 22 is a cross-sectional view taken along the line A-A' of FIG. 21, and FIG. 23 is a cross-sectional view taken along line B-B' of FIG. 21. FIG. 24 is an exploded view of a cross-section taken along line A-A' of FIG. 21.

With reference to FIGS. 21 to 24, the coupling of the second main plate 82, the second sub-plate 132, and the second guide plate 92 will be described in detail. The coupling of the first main plate 81 (see FIG. 4), the first sub-plate, and the first guide plate 91 may also be correspondingly described.

A second insertion protrusion 82*d* protruding downwardly may be formed on a rear side of the second body 82*a* of the second main plate 82, and a second insertion protrusion hole 82*dh* may be located in a central portion of the second insertion protrusion 82*d*. A pair of second recesses 82*e* may be formed on both sides of the second insertion protrusion 82*d*, and a second recess hole 82*eh* may be located in the center of each of the second recesses 82*e*.

The second guide plate 92 may be provided with a second insertion hole 92*d* formed on a front side of the second body 92*a*, and a pair of second front holes 92*e* disposed on both sides of the second insertion hole 92*d* and smaller than the second insertion hole 92*d*.

The second sub-plate 132 may include a second body 132*a*, a second outer wall 132*b* extending upwardly and downwardly on the left side of the second body 132*a*, and ribs 132*c* integrally formed with the second body 132*a* for reinforcement. The second sub-plate 132 may include a second insertion protrusion 132*d* protruding rearwardly and a pair of second recesses 132*e* disposed on both sides of the second insertion protrusion 132*d*.

The second sub-plate 132 may include a second inner wall 132*f* extending upwardly and downwardly opposite the second outer wall 132*b*. The heights of the second inner wall 132*f* and the second outer wall 132*b* may correspond to the heights of the second inner wall 82*f* and the second outer wall 82*b* of the second main plate 82, respectively.

In addition, the second sub-plate 132 may include a second insertion hole 132*g* formed on a front side thereof, and a pair of second front holes 132*h* disposed on both sides of the second insertion hole 132*g*.

The second insertion protrusion 132*d*, the second recesses 132*e*, the second insertion hole 132*g*, and the second front holes 132*h* of the second sub-plate 132 may correspond to the second insertion protrusions 82*d* and the second recesses 82*e* of the second main plate 82 and the second insertion hole 92*d* and the second front holes 92*e* of the second guide plate 92, respectively.

A second insertion protrusion hole 132*dh* may be located at the center of the second insertion protrusion 132*d* of the second sub-plate 132, and a second recess hole 132*eh* may be located at the center of each of the second recesses 132*e*.

Such a structure may allow the second insertion protrusion 82*d* of the second main plate 82 to be inserted into the second insertion hole 132*g* of the second sub-plate 132. A member, such as a boss F may be inserted into the second insertion protrusion hole 82*dh* of the second main plate 82 and the second insertion hole 132*g* of the second sub-plate 132 to be coupled to the upper wall 24 (see FIG. 2) of the first refrigerator 10. In addition, the second insertion protrusion 132*d* of the second sub-plate 132 may be inserted into the second insertion hole 92*d* of the second guide plate 92 so that the position of the second insertion protrusion hole 132*dh* and the second insertion hole 92*d* are arranged correspondingly. A member, such as the boss F may be inserted into the second insertion protrusion hole 132*dh* and the second insertion hole 92*d* to be secured to the upper wall 24 of the first refrigerator 10.

The pair of second recesses 82*e* of the second main plate 82 may be seated on top of the pair of second front holes 132*h* of the second sub-plate 132, so that the positions of the second recess holes 82*eh* and the positions of the second front holes 132*h* may be adjustable to correspond. A member, such as a screw S may be secured to the second main plate 82 through the second recess holes 82*eh* and the second front holes 132*h*. Furthermore, the pair of second recesses 132*e* of the second sub-plate 132 may be seated on an upper side of the pair of second front holes 92*e* of the second guide plate 92, so that the positions of the second recess holes 132*eh* and the positions of the second front holes 92*e* may be adjustable to correspond. Similarly, a member, such as the screw S may be inserted into the upper wall 24 of the first refrigerator 10 through the second recess holes 132*eh* and the second front holes 92*e*. As a result, the support module 70 including the sub-plate 130 may be secured to the upper side of the first refrigerator 10.

Hereinafter, with reference to FIGS. 1 to 6 and FIGS. 20 to 24, a method of installing the first refrigerator 10 and the second refrigerator 40 will be described in detail. The first refrigerator 10 and the second refrigerator 40 may be of corresponding shapes, and may be used as small refrigerators in themselves. The first refrigerator 10 may be coupled with the casters 33 and 34 (see FIG. 12) at the rear lower side and with the legs 31 and 32 at the front lower side. The first refrigerator 10 coupled with the casters 33 and 34 and the legs 31 and 32 may be installed. The main plate 80 may first be installed on the upper wall 24 of the first refrigerator 10. The sub-plate 130 may be inserted depending on the size of the refrigerator, and the guide plate 90 and the guide levers 93 and 94 may be coupled to the rear side of the main plate 80 or the rear side of the sub-plate 130, respectively, Then, the legs 61 and 62 may be disassembled from the second refrigerator 40 coupled with the legs 61 and 62 and the casters 63 and 64. The disassembled legs 61 and 62 are inserted from the front side of the main plate 80 and secured with the bracket 110, and then the front cover 100 may be coupled to the main plate 80. The second refrigerator 40 may then be coupled to the upper side of the first refrigerator 10 from the rear side by inserting the legs 61 and 62 into the leg grooves 52*e* while seating the casters 63 and 64 on the guide levers 93 and 94, respectively. The user may adjust the inclination of the second refrigerator 40 and the first refrigerator 10 by the guide levers 93 and 94 after measuring the inclination with respect to a surrounding furniture cabinet so that the second refrigerator 40 and the first refrigerator 10 are tilted by 0.1 degree in the front-to-back direction. Afterwards, the fastener 120 may be coupled to the rear side of the guide plate 90. As such, the first refrigerator 10 and the second refrigerator 40 may be installed on a furniture cabinet or the like.

However, such an order is not limited thereto, and the legs 61 and 62 of the second refrigerator 40 may be directly coupled to the support module 70 without disassembling the legs from the second refrigerator, and it is sufficient for the second refrigerator 40 to be stacked on the upper side of the first refrigerator 10.

Figure 25:
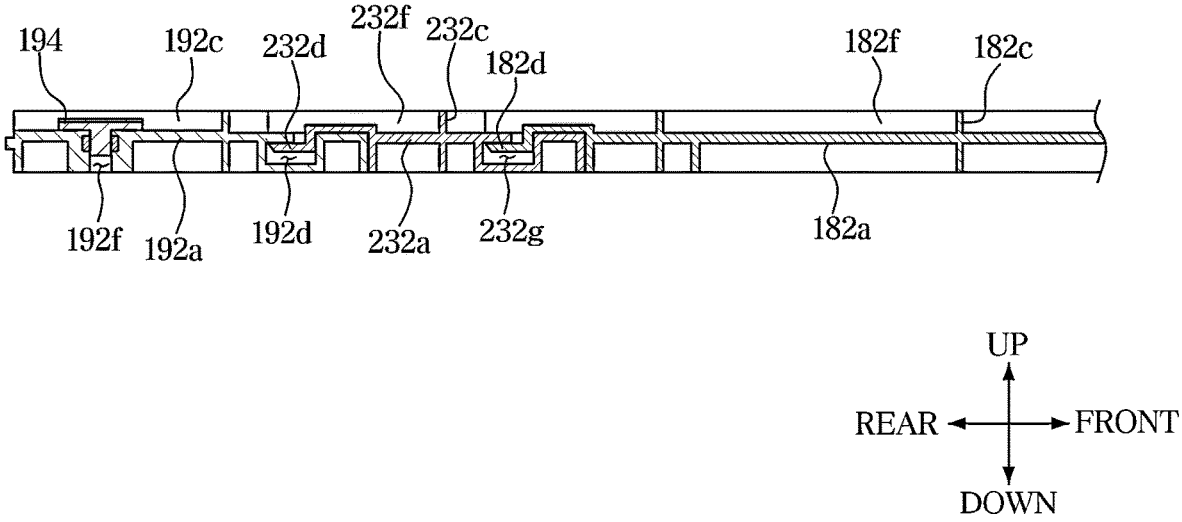
FIGS. 25 and 26 are respectively a side sectional view and an exploded side sectional view showing coupling protrusions and coupling grooves having different geometries.
Figure 26:
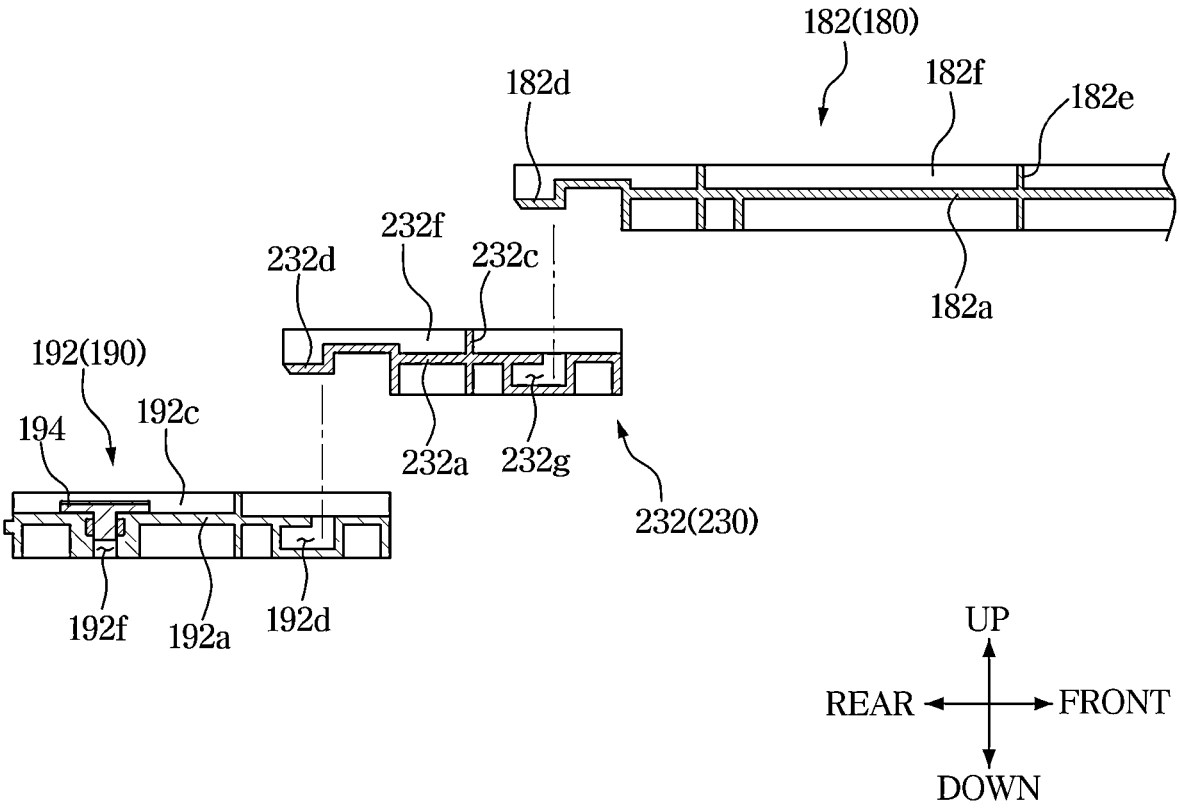

FIGS. 25 and 26 are views showing the coupling of a support module due to the coupling of an insertion protrusion and an insertion groove, according to another embodiment. Referring to FIGS. 25 and 26, in contrast to FIGS. 21 to 24, a second insertion protrusion 182*d* of a second main plate 182 may be inserted into an insertion groove 232*g* of a second sub-plate 232 as a hook member instead of a member such as the boss F passing through a hole formed at the central portion, so that the second main plate 182 and the second sub-plate 232 may be hook-coupled. In addition, a second insertion protrusion 232*d* of the second sub-plate 232 may be inserted into an insertion groove 192*d* of a second guide plate 192, so that the second sub-plate 232 and the second guide plate 192 may be hook-coupled.

Figure 27:
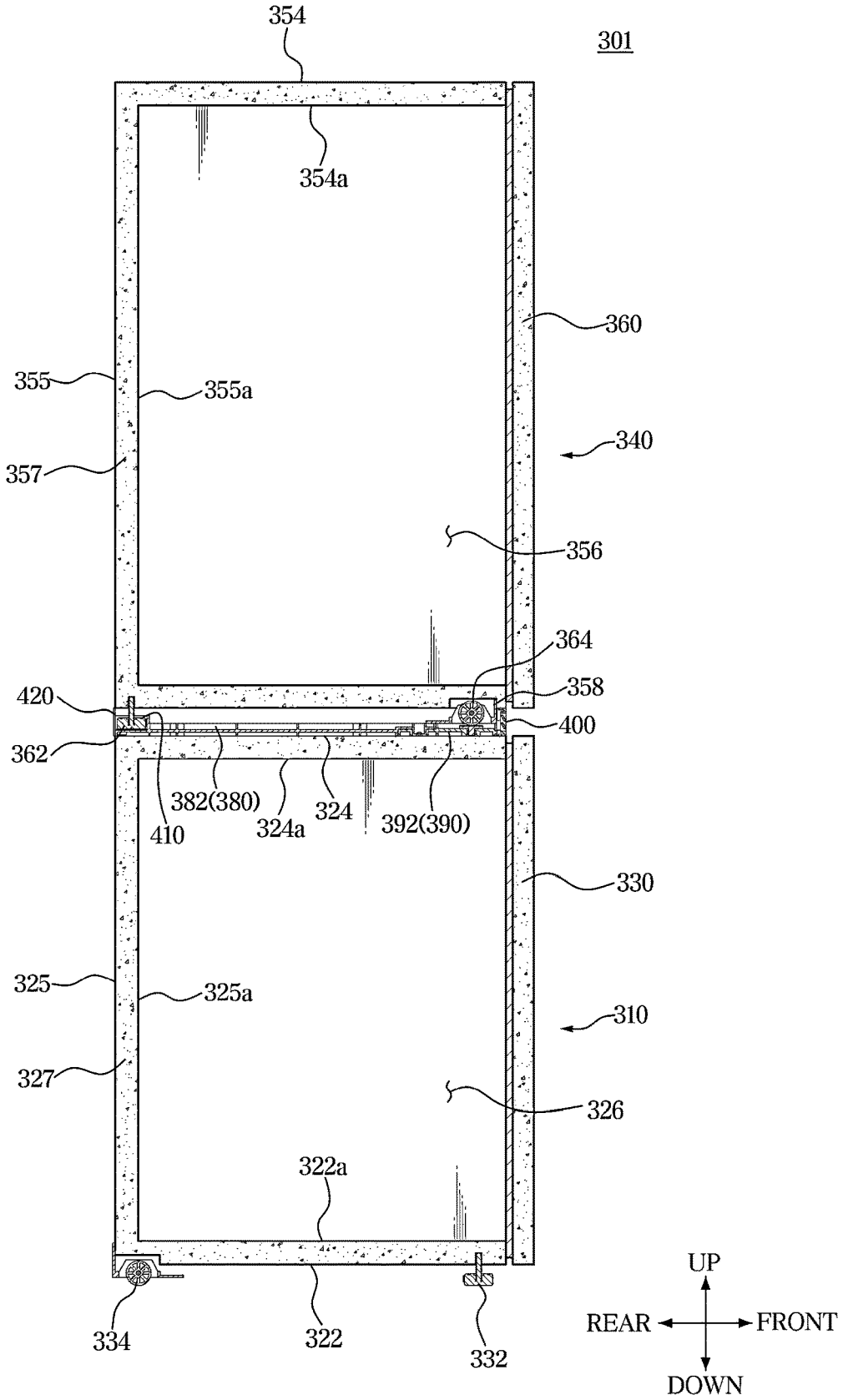
FIG. 27 is an exploded side view of a refrigerator including a support module, according to another embodiment.

FIG. 27 is a side cross-sectional view of a refrigerator 301 according to another embodiment. Referring to FIG. 27, in contrast to the refrigerator according to the above embodiments, a caster 362 may support a lower side of a second refrigerator 340 at the front, and a leg 364 may support the lower side of the second refrigerator 340 at the rear. In other words, two casters may be placed at the front and two legs may be placed at the rear to support the second refrigerator 340. According to such a structure, a first refrigerator 310 and the second refrigerator 340 may be tilted by adjusting the casters 362 or the like by removing only a front cover 400 without removing the first refrigerator 310 and the second refrigerator 340 from the furniture cabinet or the like.

While the present disclosure has been particularly described with reference to exemplary embodiments, it should be understood by those of skilled in the art that various changes in form and details may be made without departing from the spirit and scope of the present disclosure.

What is claimed is:

1. A refrigerator comprising:

a first refrigerator;

a second refrigerator stackable on an upper side of the first refrigerator, the second refrigerator including a caster disposed on a rear lower side thereof; and a support module disposed between the first refrigerator and the second refrigerator to allow the second refrigerator to be stacked on the upper side of the first refrigerator;

wherein the support module includes:

a main plate coupled to an upper wall of the first refrigerator;

a leg disposed on a front side of the main plate to support a front lower side of the second refrigerator;

a guide plate coupled to a rear side of the main plate; and a guide lever vertically movably coupled to the guide plate, and to support the caster to move vertically in response to the guide lever being in contact with the caster.

2. The refrigerator of claim 1, wherein the support module is configured to adjust a step between the second refrigerator and the first refrigerator by moving the caster vertically based on a rotation of the guide lever.

3. The refrigerator of claim 2, wherein the guide lever includes:

a seating member on which the caster is seated; and a rotating member disposed on a lower side of the seating member and configured to move the seating member vertically based on a rotation of the rotating member, thereby moving the caster vertically.

4. The refrigerator of claim 3, wherein the guide plate includes a coupling hole into which the rotating member is inserted, and the rotating member includes a rotating shaft inserted into the coupling hole and a rotating plate disposed on an upper side of the rotating shaft to support the seating member.

5. The refrigerator of claim 4, wherein the seating member has a shape of a hexagonal plate.

6. The refrigerator of claim 1, wherein the guide plate includes an insertion hole disposed on a front side thereof, and the main plate includes an insertion protrusion protruding rearwardly and downwardly so as to be inserted into the insertion hole.

7. The refrigerator of claim 1, wherein the support module includes:

a front cover disposed on the front side of the main plate, and a bracket disposed between the front cover and the main plate to secure the leg.

8. The refrigerator of claim 7, wherein the front cover includes a blade extending in a left-to-right direction of the first refrigerator and forming an opening to flow external air from the front cover into a space between the first refrigerator and the second refrigerator.

9. The refrigerator of claim 8, wherein the blade extends rearwardly and is arranged to be inclined upwardly to allow external air to flow into the space between the first refrigerator and the second refrigerator.

10. The refrigerator of claim 1, wherein the main plate includes a body and an outer wall extending upwardly from an outside of the body to cover a space between the first refrigerator and the second refrigerator.

11. The refrigerator of claim 10, wherein the guide plate includes a body coupled to the guide lever and an outer wall extending upwardly from the outside of the body, and the outer wall of the guide plate has a height corresponding to a height of the outer wall of the main plate.

12. The refrigerator of claim 10, wherein the main plate includes an inner wall extending upwardly from the body in a direction opposite to the outer wall and formed to be lower in height than the outer wall, and the inner wall includes an inclined surface formed to be inclined upwardly toward the outer wall to guide air.

13. The refrigerator of claim 3, further comprising, between the main plate and the guide plate, a sub-plate detachably coupled to the main plate and the guide plate, respectively.

14. The refrigerator of claim 13, wherein the guide plate includes an insertion hole disposed on a front side thereof, the main plate includes an insertion protrusion protruding toward a rear lower side, and the sub-plate includes a body including an insertion hole at the front side into which the insertion protrusion of the main plate is inserted, and an insertion protrusion at the rear lower side protruding rearwardly and downwardly to be inserted into the insertion hole of the guide plate.

15. The refrigerator of claim 7, wherein the bracket includes an inlet extending in a left-to-right direction of the first refrigerator and configured to flow external air into a space between the first refrigerator and the second refrigerator, and the support module further includes a fastener couplable from a rear side of the guide plate, extending in a left-to-right direction of the first refrigerator, and including an outlet configured to discharge air between the first refrigerator and the second refrigerator to an outside.

16. The refrigerator of claim 1, wherein the second refrigerator further comprises a caster coupling plate disposed on the rear lower side thereof, and a caster shaft, wherein the caster is coupled to the caster coupling plate, and rotatable with respect to the caster shaft.

* * * * *